US010181294B2

(12) United States Patent
Zhang et al.

(10) Patent No.: US 10,181,294 B2
(45) Date of Patent: Jan. 15, 2019

(54) METHOD AND APPARATUS FOR CONTROLLING LIQUID CRYSTAL DISPLAY BRIGHTNESS, AND LIQUID CRYSTAL DISPLAY DEVICE

(71) Applicants: HISENSE ELECTRIC CO., LTD., Shandong (CN); HISENSE USA CORPORATION, Suwanee, GA (US); HISENSE INTERNATIONAL CO., LTD., Shandong (CN)

(72) Inventors: Yuxin Zhang, Shandong (CN); Shunming Huang, Shandong (CN); Zhicheng Song, Shandong (CN)

(73) Assignees: Hisense Electric Co., Ltd., Shandong (CN); Hisense USA Corporation, Suwanee, GA (US); Hisense International Co., Ltd., Shandong (CN)

( * ) Notice: Subject to any disclaimer, the term of this patent is extended or adjusted under 35 U.S.C. 154(b) by 104 days.

(21) Appl. No.: 15/173,667

(22) Filed: Jun. 5, 2016

(65) Prior Publication Data

US 2017/0110064 A1 Apr. 20, 2017

(30) Foreign Application Priority Data

Oct. 16, 2015 (CN) ..... 2015 1 0665186

(51) Int. Cl.
*G09G 3/34* (2006.01)
*G09G 3/20* (2006.01)
*G09G 3/36* (2006.01)

(52) U.S. Cl.
CPC ..... *G09G 3/3406* (2013.01); *G09G 3/2018* (2013.01); *G09G 3/3426* (2013.01);
(Continued)

(58) Field of Classification Search
CPC ..... G09G 3/3406; G09G 3/2018; G09G 3/36; G09G 2310/08; G09G 2320/0646; G09G 2320/066; G09G 2330/021
(Continued)

(56) References Cited

U.S. PATENT DOCUMENTS 7,436,415 B2 10/2008 Takata et al.
7,638,754 B2 12/2009 Morimoto et al.
(Continued)

FOREIGN PATENT DOCUMENTS

CN 101236728 A 8/2008
CN 101271208 A 9/2008
(Continued)

OTHER PUBLICATIONS

English translation of a first Office Action issued in Chinese Application No. 201410267408.5 dated Jul. 10, 2017.
(Continued)

*Primary Examiner* — Nicholas Lee
*Assistant Examiner* — Ngan T Pham Lu
(74) *Attorney, Agent, or Firm* — Hoffmann & Baron, LLP

(57) ABSTRACT

This disclosure provides a method and apparatus for controlling liquid crystal display brightness, and a liquid crystal display device, and relates to the field of liquid crystal display technologies, where the method includes: determining grayscale values of all pixels in a zone image data block under a predetermined rule according to a received image signal, and pre-obtaining a zone backlight value corresponding to the zone image data block according to the grayscale values; multiplying the pre-obtained zone backlight value with a backlight value gain coefficient to obtain a backlight value of a backlight zone corresponding to the zone image data block to which a gain is applied, wherein the backlight value gain coefficient is more than 1; and outputting the
(Continued)

backlight value of the backlight zone to a driver circuit of backlight source in the backlight zone to control the brightness of the backlight source in the backlight zone as a result of driving, thus improving the effect of contrast quality of pictures displayed by the liquid crystal display device.

20 Claims, 17 Drawing Sheets

(52) U.S. Cl.
CPC ..... *G09G 3/36* (2013.01); *G09G 2310/08* (2013.01); *G09G 2320/066* (2013.01); *G09G 2320/0646* (2013.01); *G09G 2330/021* (2013.01)

(58) Field of Classification Search
USPC ..... 345/690
See application file for complete search history.

(56) References Cited

U.S. PATENT DOCUMENTS

| | | | | |
|---|---|---|---|---|
| 2004/0257329 | A1 | 12/2004 | Park et al. | |
| 2005/0057487 | A1 | 3/2005 | Takata et al. | |
| 2005/0179639 | A1 | 8/2005 | Hsieh | |
| 2007/0001997 | A1 | 1/2007 | Kim et al. | |
| 2007/0030697 | A1 | 2/2007 | Kim | |
| 2007/0216636 | A1 | 9/2007 | Lo | |
| 2007/0222730 | A1* | 9/2007 | Kao | G09G 3/2059 345/89 |
| 2008/0055231 | A1 | 3/2008 | Nose et al. | |
| 2008/0180383 | A1 | 7/2008 | Lin et al. | |
| 2008/0186393 | A1 | 8/2008 | Lee et al. | |
| 2008/0245949 | A1 | 10/2008 | Morimoto et al. | |
| 2008/0284719 | A1 | 11/2008 | Yoshida | |
| 2009/0066632 | A1 | 3/2009 | Chen | |
| 2009/0128583 | A1 | 5/2009 | Choi | |
| 2009/0167670 | A1 | 7/2009 | Peng et al. | |
| 2009/0189842 | A1 | 7/2009 | Huang et al. | |
| 2010/0020005 | A1 | 1/2010 | Jung et al. | |
| 2010/0066657 | A1 | 3/2010 | Park et al. | |
| 2010/0103089 | A1 | 4/2010 | Yoshida et al. | |
| 2010/0164922 | A1 | 7/2010 | Nose et al. | |
| 2010/0245397 | A1 | 9/2010 | Choe et al. | |
| 2011/0051161 | A1 | 3/2011 | Yen et al. | |
| 2011/0205442 | A1* | 8/2011 | Mori | G09G 3/3208 348/673 |
| 2011/0227966 | A1 | 9/2011 | Mori | |
| 2011/0292018 | A1* | 12/2011 | Kubota | G09G 3/3426 345/211 |
| 2012/0249613 | A1 | 10/2012 | Takada et al. | |
| 2013/0120471 | A1 | 5/2013 | Lin et al. | |
| 2013/0265337 | A1 | 10/2013 | Furomoto et al. | |
| 2015/0009249 | A1 | 1/2015 | Kudo et al. | |
| 2015/0029237 | A1 | 1/2015 | Chen et al. | |
| 2015/0213781 | A1 | 7/2015 | Huang | |
| 2015/0339967 | A1 | 11/2015 | Shin | |
| 2016/0035285 | A1 | 2/2016 | Jung | |
| 2016/0284283 | A1 | 9/2016 | Kurita | |

FOREIGN PATENT DOCUMENTS

| | | | |
|---|---|---|---|
| CN | 101329458 | A | 12/2008 |
| CN | 101383139 | A | 3/2009 |
| CN | 101388183 | A | 3/2009 |
| CN | 101650921 | A | 2/2010 |
| CN | 101673521 | A | 3/2010 |
| CN | 201607919 | U | 10/2010 |
| CN | 102081258 | A | 6/2011 |
| CN | 102137178 | A | 7/2011 |
| CN | 102243855 | A | 11/2011 |
| CN | 102292757 | A | 12/2011 |
| CN | 102473383 | A | 5/2012 |
| CN | 102568386 | A | 7/2012 |
| CN | 102622990 | A | 8/2012 |
| CN | 102890918 | A | 1/2013 |
| CN | 103050095 | A | 4/2013 |
| CN | 103106875 | A | 5/2013 |
| CN | 103310765 | A | 9/2013 |
| CN | 104050934 | | 9/2014 |
| CN | 104599642 | A | 5/2015 |
| DE | 1020080042381 | A | 8/2008 |
| JP | 200214660 | A | 1/2001 |
| JP | 2008268798 | A | 11/2008 |
| KR | 10-2007-0117847 | | 12/2007 |
| KR | 100809073 | B1 | 3/2008 |
| KR | 1020110066510 | A | 6/2011 |
| WO | 2013166994 | A1 | 11/2013 |

OTHER PUBLICATIONS

English translation of a second Office Action issued in Chinese Application No. 201510665186.7 dated Nov. 28, 2017.
Office Action issued in U.S. Appl. No. 15/158,759 dated Sep. 14, 2018.

* cited by examiner

METHOD AND APPARATUS FOR CONTROLLING LIQUID CRYSTAL DISPLAY BRIGHTNESS, AND LIQUID CRYSTAL DISPLAY DEVICE

CROSS REFERENCE TO RELATED APPLICATION

This application claims the benefit of Chinese Patent Application No. 201510665186.7, filed with the State Intellectual Property Office of People's Republic of China on Oct. 16, 2015, which is hereby incorporated by reference in its entirety.

FIELD

This disclosure relates to the field of liquid crystal display technologies and particularly to a method and apparatus for controlling liquid crystal display brightness, and a liquid crystal display device.

BACKGROUND

A Liquid Crystal Display (LCD) device typically controls backlight brightness through dynamic backlight modulation to thereby save energy and improve the display contrast and other image quality-of-picture effects. FIG. 1 is a structural principle diagram of dynamic backlight modulation in the liquid crystal display device in the prior art, where the liquid crystal display device includes an image processing component configured to receive an input image signal, and to acquire backlight data as a function of grayscale brightness of the image signal. On the one hand, the image signal is converted in format according to the predetermined specification of a display panel, and output to a timing controller (Tcon) in a liquid crystal display component, and a timing control signal and a data signal are generated by the timing controller to drive the liquid crystal panel, and on the other hand, the acquired backlight data are output to a backlight processing component. The backlight data are converted by the backlight processing component into a backlight control signal to control a backlight driver component to control brightness of backlight sources in a backlight assembly so that if the brightness of the image is high, then the backlight source will be driven for high backlight brightness, and if the brightness of the image is low, then the backlight source will be driven for low backlight brightness.

SUMMARY

In an aspect, an embodiment of this disclosure provides a method of controlling liquid crystal display brightness, the method including: determining, by a liquid crystal display device, grayscale values of pixels in a zone image data blocks under a predetermined rule according to a received image signal, and pre-obtaining, by the liquid crystal display device, a zone backlight value corresponding to the zone image data block according to the grayscale values in the zone image data block, multiplying, by the liquid crystal display device, the pre-obtained zone backlight value with a backlight value gain coefficient to obtain a backlight value of a backlight zone corresponding to the zone image data block to which a gain is applied, wherein the backlight value gain coefficient is more than 1; determining, by the liquid crystal display device, a backlight gain adjustment factor as a function of ambient luminance, and multiplying, by the liquid crystal display device, the zone backlight value of the backlight zone to which the gain is applied, with the backlight gain adjustment factor to obtain an adjusted backlight value of the backlight zone to which the gain is applied; and outputting, by the liquid crystal display device, the adjusted backlight value of the backlight zone to which the gain is applied to a driver circuit of a backlight source in the backlight zone to control the brightness of the backlight source in the backlight zone as a result of the driver circuit driving the backlight source.

In another aspect, an embodiment of this disclosure provides an apparatus to control liquid crystal display brightness, the apparatus including: a zone image grayscale determining section configured to determine grayscale values of pixels in a zone image data block under a predetermined rule according to a received image signal; a zone backlight value pre-obtaining section configured to pre-obtain a zone backlight value corresponding to the zone image data block according to the grayscale values in the zone image data block; a zone backlight value gain section configured to multiply the pre-obtained zone backlight value with a backlight value gain coefficient to obtain a backlight value of a backlight zone corresponding to the zone image data block to which a gain is applied, wherein the backlight value gain coefficient is more than 1; a backlight value gain adjusting section configured to determine a backlight gain adjustment factor as a function of ambient luminance, and to multiply the zone backlight value of the backlight zone to which the gain is applied, with the backlight gain adjustment factors of the backlight zone to obtain an adjusted backlight value of the backlight zone to which the gain is applied; and a zone backlight value outputting section configured to output the adjusted backlight value of the backlight zone to which the gain is applied to a driver circuit of backlight source in the backlight zone to control the brightness of the backlight source in the backlight zone as a result of the driver circuit driving the backlight source.

In a further aspect, an embodiment of this disclosure provides a liquid crystal display device including: a memory configured to store programs and various preset lookup table data; an apparatus to control liquid crystal display brightness configured to execute the programs in the memory, and to invoke the various lookup table data according to the executed programs; to receive an image signal, to process the data, and to output image data to a timing controller so that the timing controller generates a driver signal according to the image data to control a liquid crystal panel to display an image; and to output zone backlight values to a backlight processing unit according to the image signal; the backlight processing unit configured to determine duty ratios of corresponding PWM signals according to the backlight values of backlight zones, and to output the duty ratios to a PWM driver unit; and the PWM driver unit configured to generate PWM control signals to control backlight sources in the backlight zones; wherein the apparatus to control liquid crystal display brightness is any one of the apparatuses above for controlling liquid crystal display brightness.

In the method and apparatus of controlling liquid crystal display brightness, and the liquid crystal display device, according to some embodiments of this disclosure, on the one hand, a zone backlight value of a zone image data block is pre-obtained according to the grayscale values in the zone image data block, and then the backlight value gain coefficient is obtained, the pre-obtained zone backlight value is multiplied with the backlight value gain coefficient to obtain the zone backlight value to which the gain is applied, and the zone backlight value to which the gain is applied is output to a driver circuit of backlight source to drive the backlight source in a backlight zone, thus improving the backlight peak brightness and further improving the dynamic contrast of the displayed image.

On the other hand, in this disclosure, a backlight gain adjustment factor is further determined as a function of ambient luminance, and a backlight value of a backlight zone corresponding to the zone image data block to which the gain is applied is multiplied with the backlight gain adjustment factor to obtain an adjusted backlight value of the backlight zone to which the gain is applied, so that the factor of the ambient luminance can be taken into account for the amplitude of the zone backlight gain in this disclosure, where if there is high ambient luminance, then there will be a large amplitude of the backlight gain, and if there is low ambient luminance, then there will be a small amplitude of the backlight gain. The backlight gain adjustment factor can be introduced to adjust the contrast between the backlight brightness and the ambient brightness.

DETAILED DESCRIPTION OF THE EMBODIMENTS

In order to make the objects, technical solutions, and advantages of the embodiments of this disclosure more apparent, the technical solutions according to the embodiments of this disclosure will be described below clearly and fully with reference to the drawings in the embodiments of this disclosure.

Dynamic backlight modulation generally includes zoned backlight modulation and global backlight modulation, where in global backlight modulation, the backlight brightness is controlled by acquiring the average brightness over one frame of image so that the real backlight brightness is determined by the average grayscale value across the frame of image, so the maximum average grayscale value over the image (i.e., the all-white image) corresponds to the maximized backlight brightness, and in order to guarantee the reliability of the backlight source in operation, the maximized backlight brightness is typically controlled below rated brightness of the backlight source in operation. Typically in a normally displayed picture, the average grayscale brightness across the entire dynamic video picture can be statistically known at around 50% IRE, so that the average value of the backlight brightness will be around 50% of the maximized backlight brightness. Thus, the real average power of the backlight source operating with global backlight modulation is controlled around half of the rated power, and there is an apparent effect of saving energy. However, in global backlight modulation, the average grayscale brightness across one or more consecutive frames of image is acquired, and global backlight source brightness is controlled by the average grayscale brightness of the image(s), but the average grayscale brightness of the image(s) may not reflect brightness details between local pictures of the images, and a variation in contrast of the image(s) will be more reflected in the difference in brightness between the local pictures of the images, so the global backlight modulation may not significantly improve the quality-of-picture effect for the display contrast.

Figure 1:
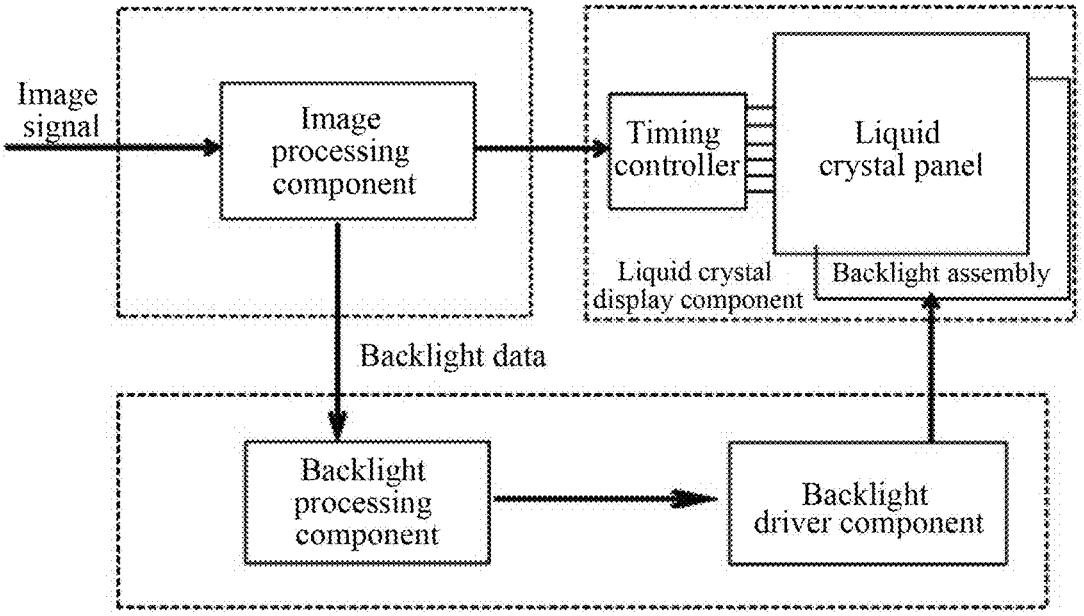
Fig. 1 (Prior Art)
FIG. 1 is a structural principle diagram of dynamic backlight modulation in the liquid crystal display device in the prior art.
Figure 2:
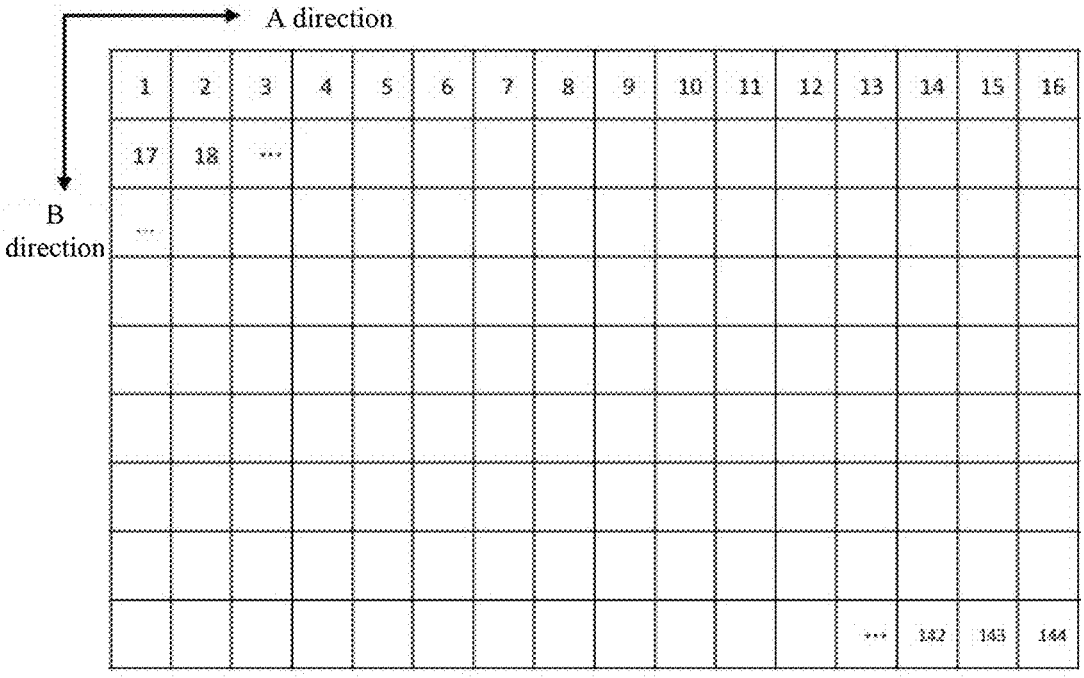
Fig. 2 (Prior Art)
FIG. 2 is a schematic diagram of backlight zones in zoned dynamic backlight modulation in the prior art.

Zoned dynamic backlight modulation will be described as follows. As illustrated in FIG. 2 which is a schematic diagram of backlight zones in zoned dynamic backlight modulation in the prior art, the entire matrix of backlight sources includes M zones in the direction A and N zones in the direction B, and as illustrated, if M=16 and N=9, then there will be M*N=144 backlight zones in total, in each of which the backlight source brightness can be controlled separately as a result of driving, where it shall be noted that ideally the respective backlight zones can illuminate their backlight areas separately, but in fact, the brightness of the adjacent backlight sources may be affected somewhat. In zoned dynamic backlight modulation, each frame of global image is segmented into a number of zone image data blocks corresponding to the backlight zones, and grayscale data in the respective zone image data blocks are acquired to obtain the backlight data of the corresponding backlight zones, and the obtained backlight data of the respective zones reflect the differences in brightness between the corresponding zone image data blocks, so that the backlight brightness of the backlight zones will be determined by the brightness of the image data blocks corresponding to the backlight zones, and the variations in backlight brightness of the zones will reflect the grayscale brightness in the zone image data blocks in which area pictures need to be displayed, and highlight the differences in display brightness between the local pictures of the displayed image, thus improving the contrast quality-of-picture effect of the dynamic picture.

In order to improve the effect of a dynamic contrast quality-of-picture of a displayed image in a liquid crystal display device, zoned dynamic backlight modulation is applied so that the entire matrix of backlight sources thereof is divided into a number of backlight zones in row and column directions, and the backlight sources in each backlight zone can be driven separately to drive brightness thereof, where it shall be noted that if the respective backlight zones are ideal, then the respective backlight zones can illuminate separately their backlight zones, but in fact, the brightness of the adjacent backlight sources may be affected somewhat. Image grayscale brightness of zone image data blocks displayed on a liquid crystal display panel corresponding to the backlight zones is acquired, backlight values of the backlight zones are obtained as a function of the image grayscale brightness in an algorithm of obtaining the backlight values, and the backlight sources in the zones are driven by the backlight values to emit light so as to provide desirable backlight brightness for the image in the zones to be displayed. It shall be noted that the zone image data blocks refer to aggregation of image data of all the pixels displayed in display zones of the liquid crystal panel at the same positions as the backlight zones, where the liquid crystal display panel is zoned uniformly under the same zoning rule as the backlight zones, where the backlight zones may not overlap completely with the boundaries of the areas displayed on the liquid crystal panel corresponding to the zone image data blocks due to a design error and a process error, or taking into account a design need or other factors. It shall be further noted that the backlight zones and the zones of the liquid crystal panel relate to virtual boundaries instead of physical boundaries in a real design.

Figure 3:
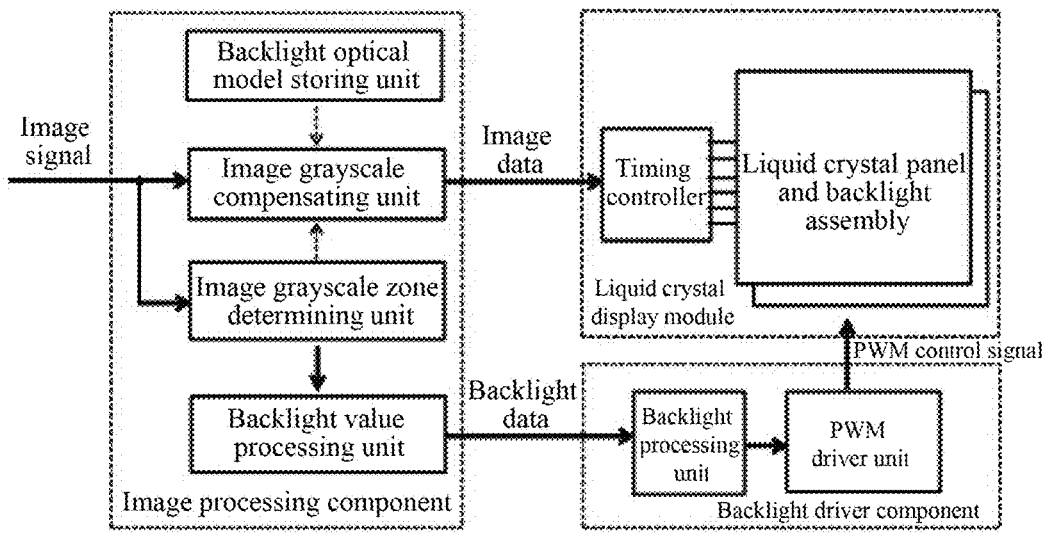
Fig. 3 (Prior Art)
FIG. 3 is a structural diagram of obtaining backlight values of the backlight zones in zoned dynamic backlight modulation in the prior art.

FIG. 3 illustrates how the backlight values of the backlight data of the image are acquired in zoned dynamic backlight modulation in the prior art, where an image processing component receives an input image signal, and on the one hand, an image grayscale zone determining unit is configured to determine a brightness grayscale of each image pixel in a zone image data block in the image signal, and a backlight value processing unit is configured to obtain a backlight value of a backlight zone corresponding to the zone image data block from a determination result, where the backlight value can be obtained particularly as the maximum value, the average value, the average value of weighted values, the weighted value of average values, etc., and on the other hand, in order to compensate for a difference in display brightness of the image arising from different backlight brightness in the different backlight zones, an image grayscale compensating unit can further perform a predetermined image data grayscale compensation algorithm on the backlight value in each backlight zone according to a preset function relationship in a backlight optical model storing unit, and obtain and output compensated image data to a timing controller to drive the liquid crystal panel to display the image. Particularly, in the algorithm above for obtaining the backlight value, for example, if the image grayscale of each image pixel ranges from 0 to 255, then the backlight value of the backlight zone will be obtained as any one value from 0 to 255; and then a backlight processing unit receives and then converts directly the any one backlight value from 0 to 255 into a PWM backlight drive signal to drive the backlight sources in the backlight zone, where the backlight source is driven by the maximum backlight value of 255 accordingly for the maximum backlight brightness, and the backlight source is driven by any other backlight value between 0 and 255 for lower peak brightness than the maximum backlight brightness. As can be known from an analysis thereof, the index of picture contrast is determined by the maximum peak brightness and the minimum display brightness, i.e., the ratio of display brightness of a picture at the display grayscale value of 255 to display brightness of a picture at the display grayscale value of 0, but the brightness of the picture at the display grayscale value of 0 is typically predetermined and hardly influenced by the backlight brightness, so the maximum peak brightness is a predominating factor of the index of displayed picture contrast. As can be known from the analysis above, since the backlight peak brightness of each zone is limited to the maximum backlight value of 255, an improvement to the contrast of the displayed picture may be discouraged.

In order to address the limited algorithm in which the backlight values are obtained in the prior art, so as to further improve the effect of the contrast quality of picture in the image displayed by the liquid crystal display device using dynamic backlight control on the zones, this disclosure proposes a method and apparatus for controlling liquid crystal display brightness, and a liquid crystal display device.

All the embodiments of this disclosure relate to an 8-bit ($2^8$=256 grayscales) liquid crystal display screen by way of an example.

Figure 4:
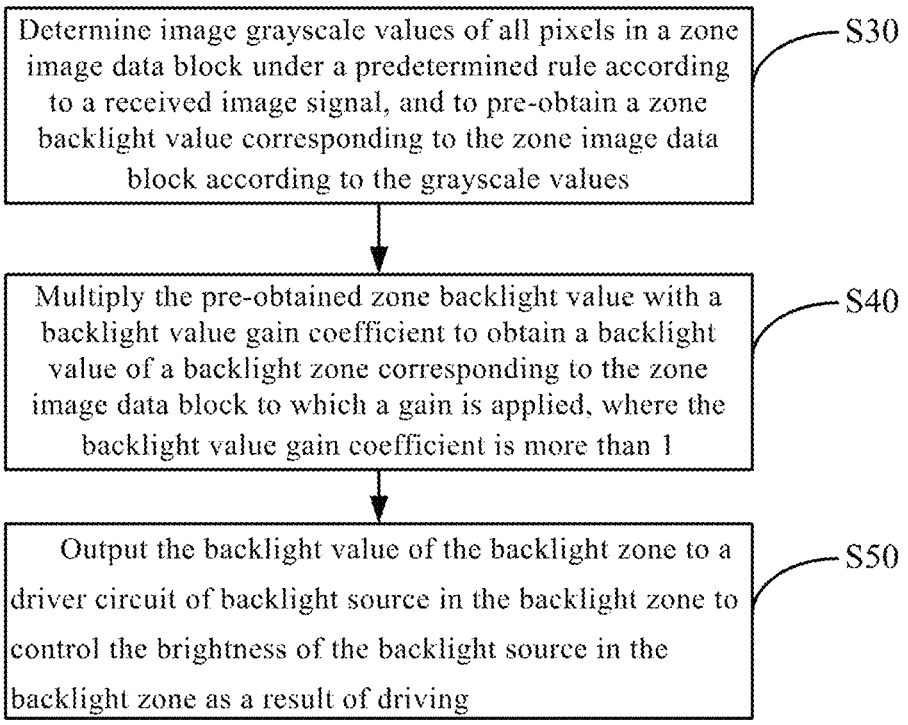
FIG. 4 is a schematic flowchart of a method for controlling liquid crystal display brightness according to an embodiment of this disclosure.

FIG. 4 is a schematic flowchart of a method for controlling liquid crystal display brightness according to a first embodiment of this disclosure. As illustrated in FIG. 4, an executor of this embodiment can be an image processing device in which processing and storing functions are integrated. The image processing device can be a single video processing chip, or consisted of a number of video processing chips cooperating with each other, and can be arranged in a liquid crystal display device with controlled zoned dynamic backlight, where the liquid crystal display device can be a liquid crystal TV set, a liquid crystal display, a tablet computer, etc.; and with this method, backlight values for driving brightness of backlight sources in respective backlight zones are generated for an input image signal to improve the effect of display contrast of the image as a whole, and the method for controlling liquid crystal display brightness includes:

The step S30 is to determine grayscale values of pixels in a zone image data block under a predetermined rule according to a received image signal, and to pre-obtain a zone backlight value corresponding to the zone image data block according to the grayscale values.

In this embodiment, the predetermined rule can be a pre-stored function model. In this function model, a liquid crystal panel is divided into a number of virtual zones at the same proportion as the backlight zones. Image data of all pixels displayed in one of the virtual zones are aggregated into a zone image data block.

Particularly, the zone backlight value of each zone image data block can be pre-obtained from the grayscale values of pixels in a backlight zone corresponding to the zone image data block in a preset algorithm, where the pre-obtained zone backlight value is not finally used to drive a backlight source, but a gain will be further applied to the pre-obtained zone backlight value and/or the pre-obtained zone backlight value will be adjusted, thus resulting in a final backlight value.

It shall be noted that the preset algorithm can be an algorithm of averaging the grayscales of all pixels, or can be an algorithm of averaging the maximum values of red, green, and blue sub-pixels in the respective pixels, or can be an algorithm of averaging their weighted grayscales, where weight coefficients thereof can be preset; and those skilled in the art can devise other particular algorithms of obtaining the backlight values without any inventive effort. The backlight data of the zones can be obtained in alternative algorithms in this embodiment and other embodiments, so the embodiments of this disclosure will not be limited thereto.

By way of an example, the matrix of backlight sources in the liquid crystal display panel is divided into 16 zones in the row direction (the horizontal direction) and 9 zones in the column direction (the vertical direction), that is, the entire matrix of backlight sources are divided into 144 backlight zones, in each of which backlight sources can be driven separately to control brightness, where the brightness can be controlled through current or Pulse Width Modulation (PWM)-controlling, and the backlight sources can be LED backlight sources. The resolution of the liquid crystal display panel in the liquid crystal display device is 3840*2160, and accordingly there are 16*9 virtual zones on the liquid crystal display panel under a backlight zoning rule. As per the positions where the virtual zones of the image data on the liquid crystal display panel are displayed, the image data are segmented into 16*9 zone image data blocks according to the predetermined function model, where each zone image data block includes 240*240 pixels, so the 240*240 pixels in each zone image data block are displayed on one virtual zone of the display panel at display brightness controlled by the backlight sources in the corresponding backlight zone. Then grayscale values of the 240*240 pixels in the one zone image data block are determined, the average of the grayscale values of the zone image data block is obtained as 160 in the predetermined backlight algorithm, and the pre-obtained zone backlight value of the backlight zone corresponding to the zone image data block is obtained as 160; and the pre-obtained zone backlight values of the other backlight zones are obtained similarly.

It shall be noted that the backlight zone may not overlap completely with the boundary of the area displayed on the liquid crystal panel corresponding to the zone image data block due to a design error and a process error, or taking into account a design demand and other factors, that is, the real number of pixels in the zone image data block may be more than 240*240. Thus there may be pixels overlapping between the adjacent zone image data blocks.

The step S40 is to multiply the pre-obtained zone backlight value with a backlight value gain coefficient to obtain a backlight value of the backlight zone to which a gain is applied, where the backlight value gain coefficient is more than 1.

In this embodiment, a backlight value of a backlight zone corresponding to the zone image data block is pre-obtained as in the step S30 in which the backlight value is pre-obtained. Then the backlight value is multiplied with a backlight value gain coefficient to obtain a backlight value of the backlight zone to which the gain is applied. Since the backlight value gain coefficient is more than 1, then the backlight value of the backlight zone to which the gain is applied, as a result of the multiplication is more than the pre-obtained backlight value. Thus if the backlight peak brightness of the backlight zone is driven using the zone backlight value to which the gain is applied, then the backlight peak brightness of the backlight zone will be improved as a result of driving. As can be apparent from the analysis in the Background section, the improvement of the peak brightness in the backlight zone can enhance the contrast of the displayed pictures of an image.

It shall be noted that those skilled in the art can select the particular value of the backlight value gain coefficient as needed for the design, for example, if the backlight value gain coefficient is taken as 1.5, then each pre-obtained zone backlight value will be multiplied respectively with the backlight value gain coefficient of 1.5, or if the backlight value gain coefficient is taken as 2, then each pre-obtained zone backlight value will be multiplied respectively with the backlight value gain coefficient of 2. In order to ensure the reliability of the backlight sources being lightened, it will not be appropriate for the amplitude of the gain to be too large.

By way of an example, as in the step S30, a zone backlight value is pre-obtained as 160 in any backlight zone, and multiplied with a backlight value gain coefficient of 2 to obtain a backlight value of the backlight zone, to which the gain is applied, as 320. Thus the backlight value to which the gain is applied can be improved significantly, and the peak brightness of a backlight source of the backlight zone can be improved significantly by driving the peak brightness of the backlight source of the backlight zone using the backlight value to which the gain is applied, thus enhancing the effect of the contrast quality of picture.

In this embodiment, the backlight value gain coefficient can be some defined value more than 1 for all image frames. Thus the backlight value gain coefficient will be the same for the backlight value of each backlight zone in a picture of the same frame of image, and also the same for different frames of images, so the same backlight value gain coefficient will apply to all backlight zones in all frames of images.

Furthermore in another embodiment of this disclosure, the backlight gain coefficient can be obtained particularly by presetting a lookup table.

First Implementation

Figure 6A:
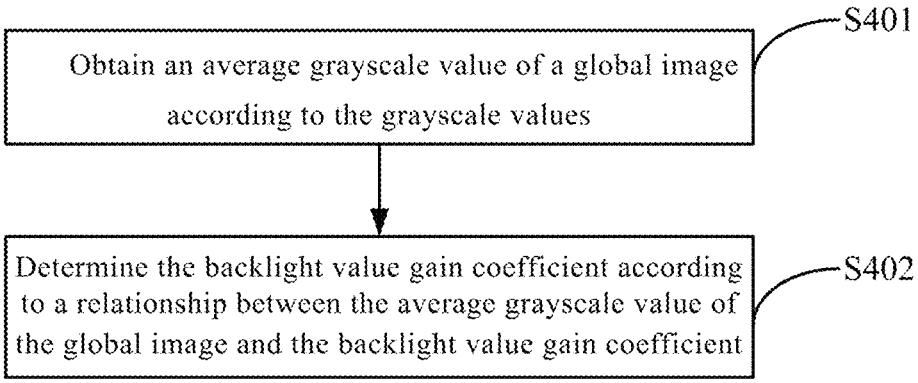
FIG. 6A is a schematic flowchart of obtaining a backlight gain coefficient according to an embodiment of this disclosure.

FIG. 6A is a schematic flowchart of a method for obtaining a backlight gain coefficient according to a first embodiment of this disclosure. The flow particularly includes:

The step S401 is to obtain an average grayscale value of a global image according to grayscale values of the image.

Figure 5A:
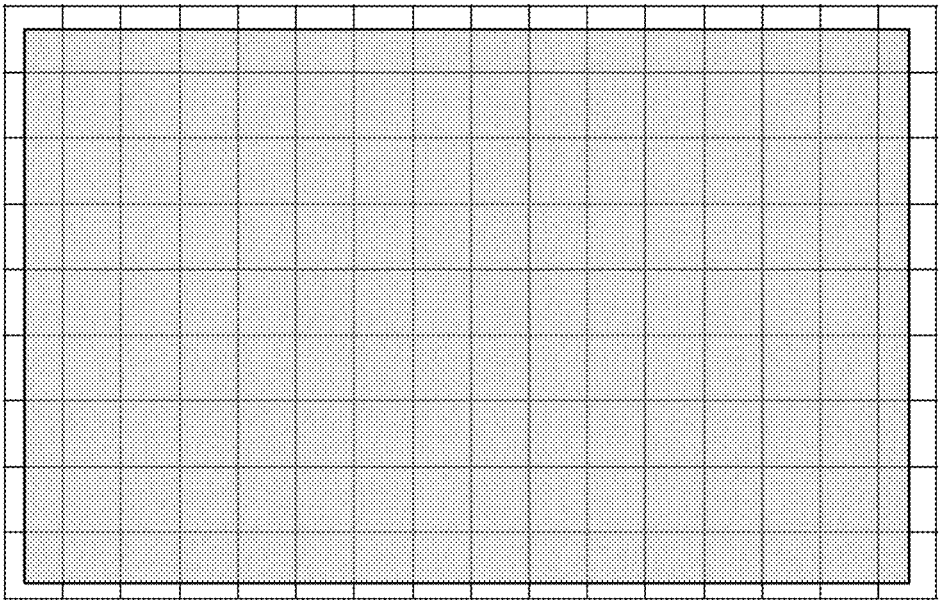
FIG. 5A is a schematic diagram of a display area segmented into image data blocks according to an embodiment of this disclosure.

By way of an example, FIG. 5A is a schematic diagram of a display area segmented into image data blocks according to the first embodiment of this disclosure. As illustrated in FIG. 2 and FIG. 5A, the display panel is similarly divided into 144 virtual zones under the backlight zoning rule. The global image displayed at the corresponding position on the display panel is segmented into 144 zone image data blocks. The grayscale values of all pixels in each zone image data block are obtained respectively. Then an average grayscale value is obtained in a preset algorithm, which can be an algorithm of averaging the grayscales of all pixels, or can be an algorithm of averaging the maximum values of red, green, and blue sub-pixels in the respective pixels, or can be an algorithm of averaging their weighted grayscales, where weight coefficients thereof can be preset. Those skilled in the art can devise other particular algorithms of obtaining the backlight values without any inventive effort, and the backlight data of backlight zones can be obtained in alternative algorithms in this embodiment and other embodiments, so the embodiments of this disclosure will not be limited thereto.

It shall be noted that in the preset algorithm, grayscale values of a zone image data block can be calculated firstly according to the step S30, and then an average grayscale value of the zone image data block can be obtained according to the grayscale values of the zone image data block so as to obtain an average grayscale value of a global image.

Alternatively, firstly grayscale value of all pixels in a global image can be obtained, and then an average grayscale value of the global image can be obtained from the grayscale values of all the pixels in the preset algorithm.

The step S402 is to determine a backlight value gain coefficient according to a relationship between an average grayscale value of a global image and the backlight value gain coefficient.

A backlight value gain coefficient lookup table needs to be pre-stored in which the correspondence relationship between an average grayscale value of an image and a backlight value gain coefficient is recorded. The average grayscale value of the image is mapped to the gain coefficient, where there are 256 grayscale values in total from 0 to 255 on the transverse axis, and each grayscale value corresponds respectively to a backlight value gain coefficient. The lookup table is searched for the backlight value gain coefficient corresponding to the average grayscale value of the image using the average grayscale value of the image.

Figure 7A:
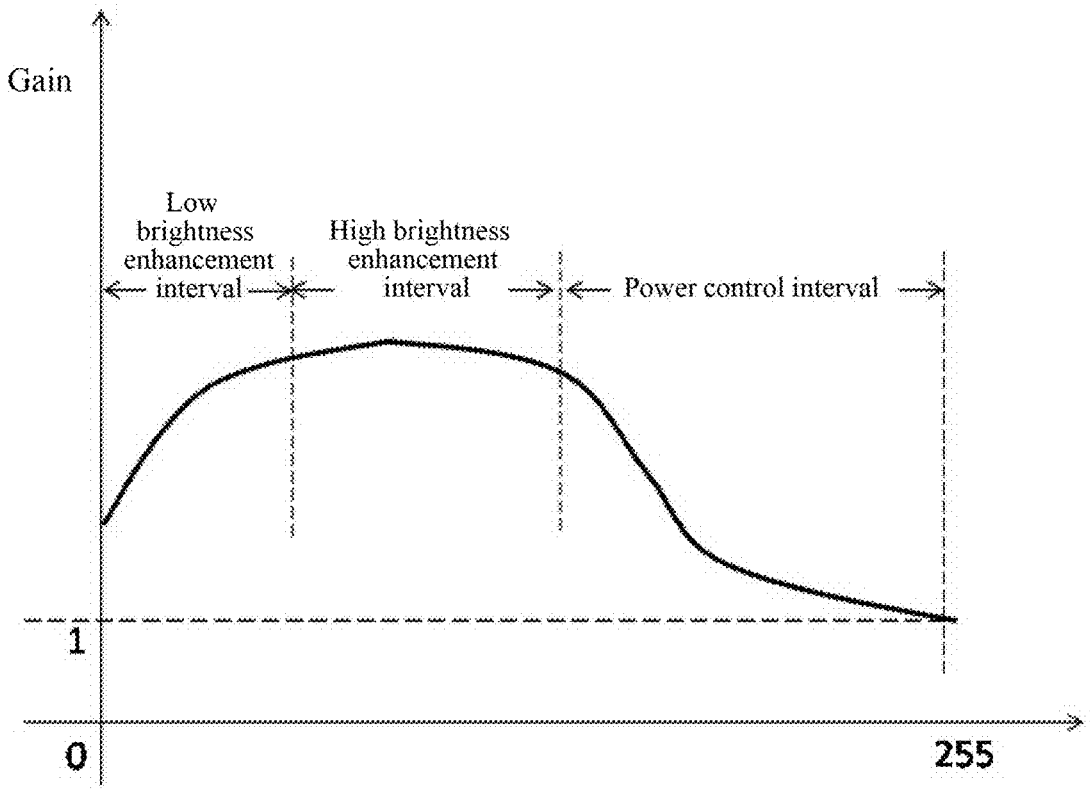
FIG. 7A is a schematic diagram of a backlight value gain curve according to an embodiment of this disclosure.

By way of an example, as illustrated in FIG. 7A, which is a schematic diagram of a backlight value gain curve according to the first embodiment of this disclosure, the gain curve can be particularly divided into a low brightness enhancement interval, a high brightness enhancement interval, and a power control interval while the average grayscale value of the image is increasing, where the gain coefficients in the high brightness enhancement interval are more than those in the low brightness enhancement interval and the power control interval respectively. If the average grayscale value of a global image is low, e.g., the average grayscale value ranges from 0 to 100, then it will lie in the low brightness enhancement interval, and the gain coefficient will increase with the increasing brightness of the global image, where if the brightness of the global image is low, then the gain coefficient will approach 1, and the amplitude of the backlight value gain will be low. As the brightness of the global image is increasing, the gain coefficient will be increasing, and the amplitude of the backlight value gain will also be increasing. If the average grayscale value of the global image is further increasing, for example, the average grayscale value ranges from 100 to 200, then it will lie in the high brightness gain interval. Since the corresponding brightness of the grayscale of the image in the high brightness gain interval is intermediate, there will be a lot of hierarchal details of the image, and the amplitude of the gain will be large, thus highlighting the sense of hierarchy in the pictures, where the maximum value of the gain coefficient lies in the high brightness gain interval. Parameters for the position of the maximum value of the gain coefficient on the curve, and the particular data thereof can be selected by those skilled in the art without any inventive effort. If the brightness of the global image is very high, for example, the average grayscale value ranges from 200 to 255, then since the overall brightness of the image is high, the brightness of the image is substantially saturated, the details of the image become less, and the brightness of the entire pictures in the backlight area is sufficiently high, so that human eyes become less sensitive to the high brightness of the image in this area, and thus it will be substantially unnecessary to further enhance the brightness of backlight, and on the contrary, power consumption will be controlled by lowering the amplitude of the backlight gain. Accordingly, the gain coefficient will become less while the average grayscale value of the global image is further increasing.

It shall be noted that in this embodiment, the backlight value gain coefficient corresponds to the grayscale brightness of the global image in each frame of image in a one-to-one manner, and the grayscale brightness of a frame of global image is uniquely determined in the predetermined algorithm, where the determined average grayscale value corresponds to a determined backlight value gain coefficient. While a frame of pictures is being displayed, all backlight values of the respective backlight zones are multiplied with the same backlight value gain coefficient. However, for typically sequentially displayed moving pictures, different average grayscale values will be obtained for different frames of images, so the different frames of images will correspond to different backlight value gain coefficients. As can be apparent from the analysis above, the different backlight gain coefficients will result in different gain amplitudes of backlight brightness, so that different gain amplitudes of backlight can be generated as a function of the changing image to thereby improve the dynamic contrast of the displayed pictures and control the power consumption of the backlight sources.

Second Implementation

Figure 6B:
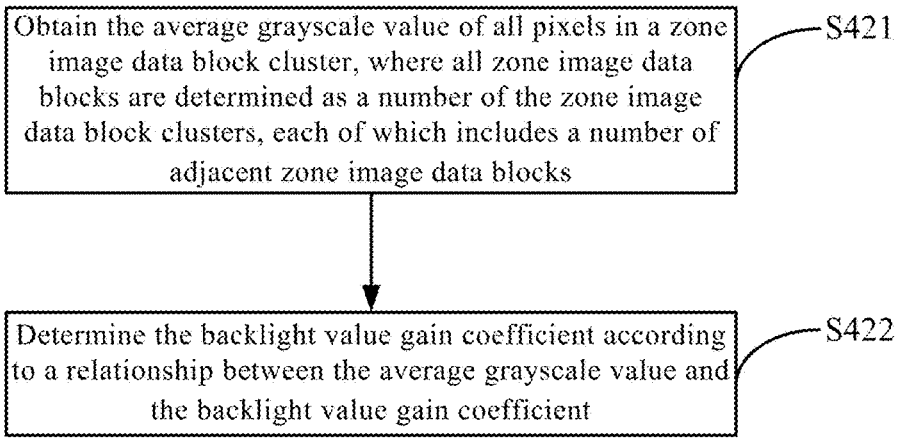
FIG. 6B is another schematic flowchart of obtaining a backlight gain coefficient according to an embodiment of this disclosure.

As illustrated in FIG. 6B, which is another schematic flowchart of obtaining a backlight value gain coefficient according to the first embodiment of this disclosure, the flow particularly includes:

The step S421 is to obtain an average grayscale value of all pixels in a zone image data block cluster, where all zone image data blocks are determined as a number of the zone image data block clusters, each of which includes a number of adjacent zone image data blocks.

By way of an example, as illustrated in FIG. 2, the entire matrix of backlight sources is divided into 16*9=144 backlight zones under the backlight zoning rule, where there are 16 zones in the row direction and 9 zones in the column direction. The display area of the display panel is divided correspondingly into 16*9=144 virtual zones under the backlight zoning rule, where a zone image data block includes aggregated image data displayed in each virtual zone of the display panel, so a frame of image data is segmented correspondingly into 16*9=144 zone image data blocks.

Figure 5B:
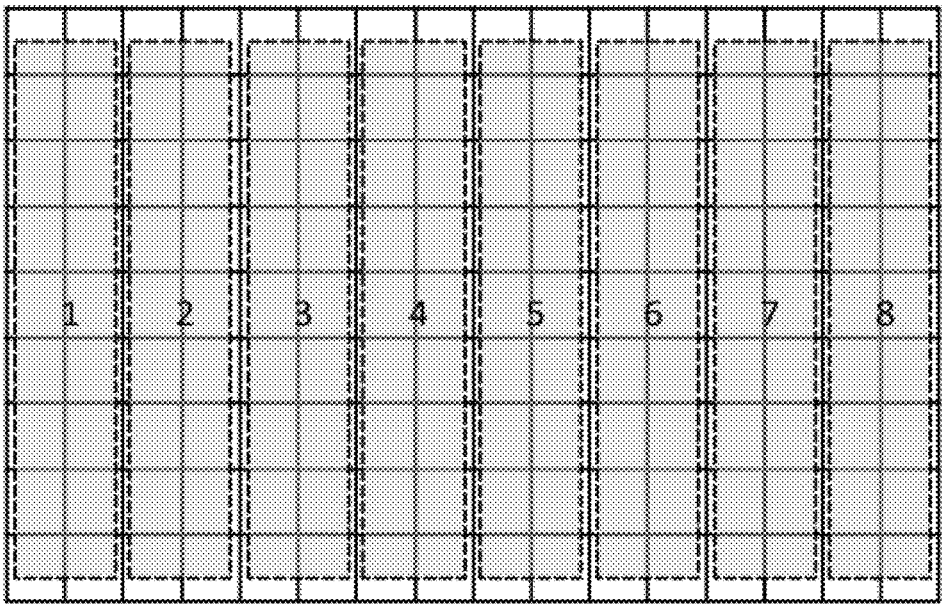
FIG. 5B is a schematic diagram of clusters into which zone image data blocks are segmented according to an embodiment of this disclosure.
Figure 5C:
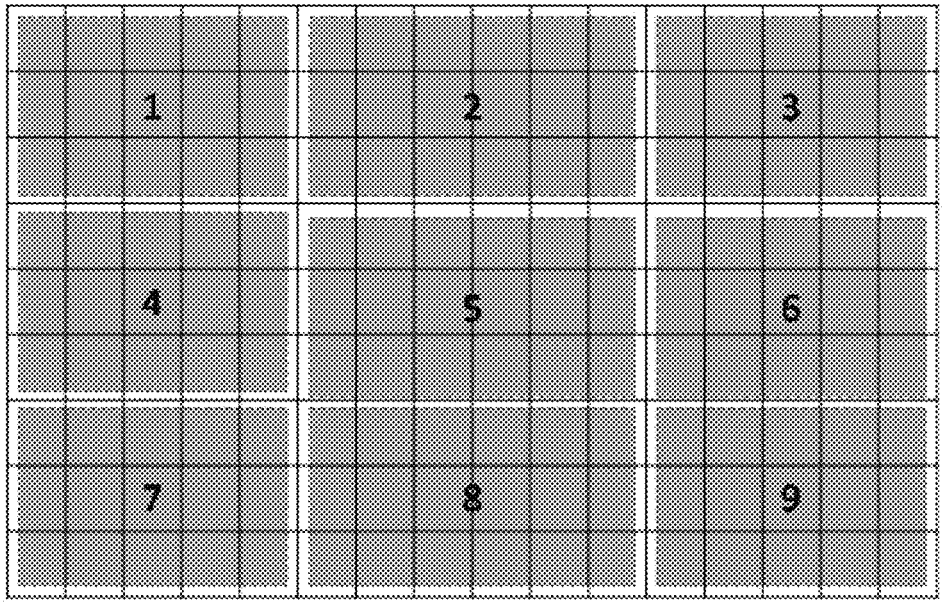
FIG. 5C is another schematic diagram of clusters into which zone image data blocks are segmented according to an embodiment of this disclosure.

As illustrated in FIG. 5B, which is a schematic diagram of zone image data blocks segmented into clusters according to the first embodiment of this disclosure, where every two columns are a zone image data block cluster, and each of zone image data block clusters includes 2*9=18 zone image data blocks, thus resulting in 8 zone image data block clusters in total. It shall be noted that a zone image data block cluster refers to aggregated data of all pixels in a number of adjacent zone image data blocks. The zone image data blocks are divided into the clusters under a rule which can be determined as required for the design, for example, they are evenly divided into 8 clusters of zone image data blocks in the column direction as illustrated in FIG. 5B, and in another example, they are divided into 9 clusters of zone image data blocks in both the row direction and the column direction as illustrated in FIG. 5C.

Grayscale values of all pixels in each of zone image data block cluster are obtained respectively, and then an average grayscale value is obtained in a preset algorithm which can be an algorithm of averaging the grayscales of all pixels, or an algorithm of averaging the maximum values of red, green, and blue sub-pixels in the respective pixels, or an algorithm of averaging their weighted grayscales, where weight coefficients thereof can be preset. Those skilled in the art can devise other particular algorithms of obtaining the backlight values without any inventive effort, and backlight data of backlight zones can be obtained in alternative algorithms in this embodiment and other embodiments, so the embodiments of this disclosure will not be limited thereto.

It shall be noted that in the preset algorithm, average grayscale values of respective zone image data blocks can be calculated firstly according to the step S30, and then average grayscale values in each of zone image data block clusters can be obtained according to the average grayscale values of respective zone image data blocks in each of the zone image data block clusters.

Stated otherwise, firstly grayscale values of all pixels in each of the zone image data block clusters can be obtained, and then average grayscale values of each zone image data block cluster can be obtained from the grayscale values of all the pixels in the preset algorithm.

The step S422 is to determine a backlight value gain coefficient according to a relationship between a zone image data block cluster and the backlight value gain coefficient.

In this embodiment, a number of gain coefficient lookup tables are preset, and there are at least two zone image data block clusters corresponding to different lookup tables in which different relationships between a backlight value gain coefficient and an average grayscale value are recorded. The backlight value gain coefficient lookup tables are pre-stored, in each of which the correspondence relationship between a grayscale value and a backlight value gain coefficient is recorded. The grayscale value is mapped to the gain coefficient, where there are 256 grayscale values in total from 0 to 255 on the transverse axis, and each grayscale value corresponds respectively to a backlight value gain coefficient. The lookup table is searched for a backlight value gain coefficient corresponding to an average grayscale value of an image using the average grayscale value of the image.

Figure 7B:
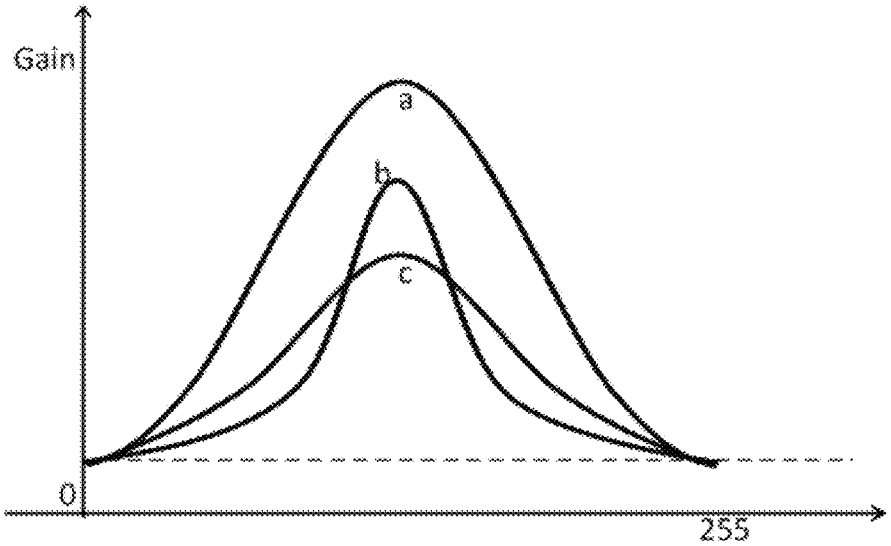
FIG. 7B is a schematic diagram of another backlight value gain curve according to the first embodiment of this disclosure.

By way of an example, as illustrated in FIG. 7B, which is a schematic diagram of another backlight value gain curve according to the first embodiment of this disclosure, there are a number of gain curves in FIG. 7B, where a zone image data block cluster corresponds to a gain curve, and there are at least two zone image data block clusters corresponding to different gain curves. A gain coefficient lookup table is matched to the position where a zone image data block cluster is distributed on the display area. Referring to FIG. 5B, the zone image data block clusters 1 and 8 correspond to the gain curve c, the zone image data block clusters 2 and 7 correspond to the gain curve b, and the zone image data block clusters 3, 4, 5, and 6 correspond to the gain curve a; and further referring to FIG. 5C, the zone image data block clusters 1, 3, 7, and 9 correspond to the gain curve c, the zone image data block clusters 2, 4, 6, and 8 correspond to the gain curve b, and the zone image data block cluster 5 corresponds to the gain curve a.

The gain curves a, b, and c are recorded in the different lookup tables to represent different relationships between a backlight gain coefficient and an average grayscale. The intermediate brightness gain coefficient in the gain curve a is larger than in the gain curves b and c, and the intermediate brightness gain coefficient in the gain curve b is larger than in the gain curve c. Stated otherwise, the general center of an angle of view at which a user is watching a displayed picture is positioned at the center of the displayed image, and the details of the displayed image, and the display focus are located at the center of the display area in order to highlight the effect of the contrast of the picture in the central area. Thus, a gain curve with a larger gain amplitude, e.g., the gain curve a, will be applied to a zone image data block cluster located in the central area of the displayed image, and a gain curve with a smaller gain amplitude, e.g., the gain curve b or the gain curve c, will be applied to a zone image data block cluster located remote from the central area of the displayed image.

FIG. 7B shows a similar trend of the varying curves to those in FIG. 7A, where each gain curve can be particularly divided into a low brightness enhancement interval, a high brightness enhancement interval, and a power control interval while the average grayscale value is increasing, where gain coefficients in the high brightness enhancement interval is more than those in the low brightness enhancement interval and the power control interval respectively (not illustrated in FIG. 7B and particularly referring to FIG. 7A). If the grayscale brightness is low, e.g., an average grayscale value ranges from 0 to 100, then it will lie in the low brightness enhancement interval, and a gain coefficient will increase with the increasing grayscale brightness, where if the grayscale brightness is low, then the gain coefficient will approach 1, and the amplitude of the backlight value gain will be low, and as the grayscale brightness is increasing, the gain coefficient will be increasing, and the amplitude of the backlight value gain will also be increasing. If the grayscale brightness is further increasing, for example, the average grayscale value ranges from 10 to 200, then it will lie in the high brightness gain interval, and since grayscale brightness of an image in the high brightness gain interval is intermediate, there will be a lot of hierarchal details of the image, and the amplitude of the gain will be large, thus highlighting the sense of hierarchy in the pictures, where the maximum value of the gain coefficient lies in the high brightness gain interval. Particular parameters for the position of the maximum value of the gain coefficient on the curve, and the particular data thereof can be selected by those skilled in the art without any inventive effort. If the grayscale brightness in the area is very high, for example, an average grayscale value ranges from 200 to 255, then since the overall brightness of the image in the area is high, the brightness of the image is substantially saturated, the details of the image become less, and the brightness of the entire pictures in the backlight area is sufficiently high, so that human eyes become less sensitive to the high brightness of the image in this area, and thus it will be substantially unnecessary to further enhance the brightness of backlight, and on the contrary, power consumption will be controlled by lowering the amplitude of the backlight gain. Accordingly, the gain coefficient will become less while the average grayscale value is further increasing.

It shall be noted that in this embodiment, a backlight value gain coefficient corresponds to an average grayscale value of all pixels in the area covered by each of zone image data block clusters in a one-to-one manner, and the average grayscale value of all the pixels in the area is uniquely determined in the predetermined algorithm. The determined average grayscale value corresponds to a determined backlight gain coefficient. While a frame of pictures is being displayed, all backlight values of the respective backlight zones in the same zone image data block cluster are multiplied with the same backlight value gain coefficient. However, the different zone image data block clusters can correspond to different backlight value gain coefficients, and the different backlight gain coefficients will result in different gain amplitudes of backlight brightness, so that different gain amplitudes of backlight can be generated as a function of the changing image to thereby improve the dynamic contrast of the displayed pictures and control the power consumption of the backlight sources.

The step S50 of FIG. 4 is to output a backlight value of a backlight zone corresponding to a zone image data block to a driver circuit of backlight source in the backlight zone to control the brightness of the backlight source in the backlight zone as a result of driving.

Figure 9:
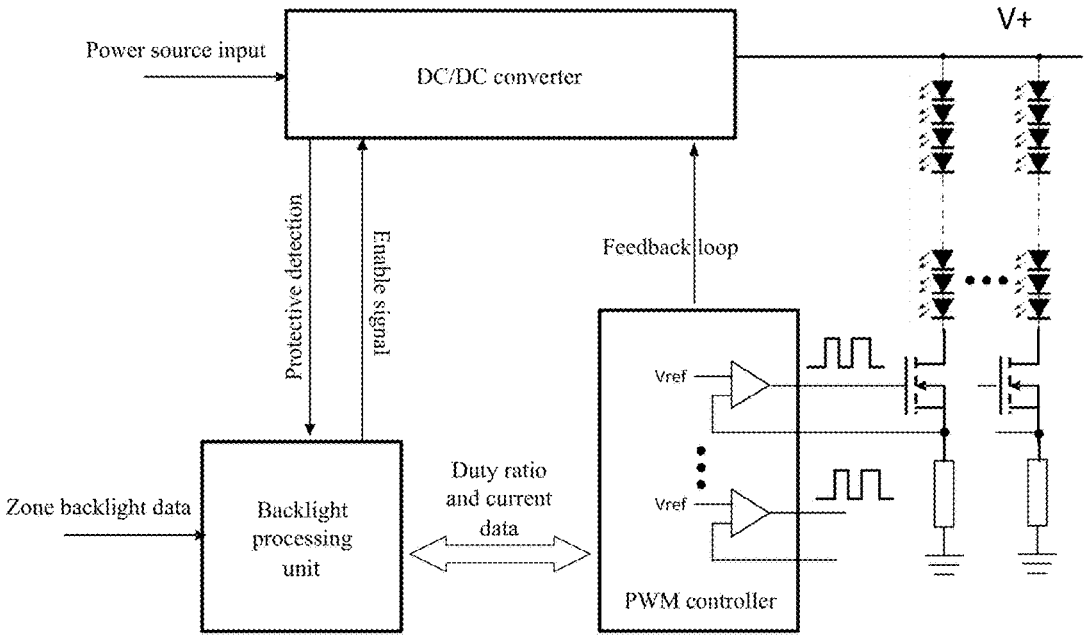
FIG. 9 is a structural diagram of drivers in backlight sources according to an embodiment of this disclosure.

In some embodiments of this disclosure, FIG. 9 is a structural diagram of the backlight source driver in the first embodiment of this disclosure. The backlight processing unit outputs a backlight value of a backlight zone corresponding to a zone image data block to which the gain is applied, to a driver circuit of backlight source in the backlight zone, and determines duty ratios of corresponding Pulse Width Modulation (PWM) signals according to backlight data of the backlight zone. If the backlight data are a brightness value ranging from 0 to 255, then the duty ratio of the PWM signal will become larger as the brightness value is increasing, and the backlight processing unit sends the determined duty ratios of the PWM signals to PWM controllers corresponding to the real backlight elements, and the PWM controllers output control signals as a function of the duty ratios to the real backlight elements to control MOS transistors connected with strings of LED lamps to be switched on and off so as to control the real backlight elements to generate brightness corresponding to the backlight data. When the PWM controllers control the real backlight elements according to the PWM duty ratios to generate the brightness corresponding to the backlight data, the amplitudes of the PWM signals can be a preset value, that is, preset current is output in reality.

In other embodiments of this disclosure, the backlight processing module can further send current data in advance to the PWM controllers, and the PWM controllers can adjust the real output current according to current data and preset reference voltage to thereby control the real backlight elements to generate the brightness corresponding to the backlight data, where there is higher backlight brightness corresponding to larger output current given a duty ratio. The real output current Iout=(current data/Imax)×(Vref/Rs), where Vref represents the preset reference voltage, e.g., 500 mV, and Rs represents the resistance of a current sampling resistor below an MOS transistor, e.g., 1Ω. The current data are typically set by operating registers in the PWM controller, and if the bit width of the register is 10 bit, then Imax=1024 in the equation above, so the current data can be calculated as a function of Iout required in reality. For example, if current of 250 mA is required, then the current data will be set at 512 in the equation above. The PWM controllers typically include a number of cascaded chips, each of which can drive a number of PWM signals to be output to the strings of LED lamps.

It shall be noted that as illustrated in FIG. 9, a DC/DC converter is configured to convert voltage output by a power source into voltage required for a string of LED lamps, and to maintain the stable voltage as a function of a feedback from a feedback circuit, and moreover the backlight processing unit can be detected for protection. The backlight processing unit can send an enable signal to the DC-DC converter after being started into operation so that the DC/DC converter starts to detect the backlight processing unit for protection from over-voltage or over-current.

Figure 8:
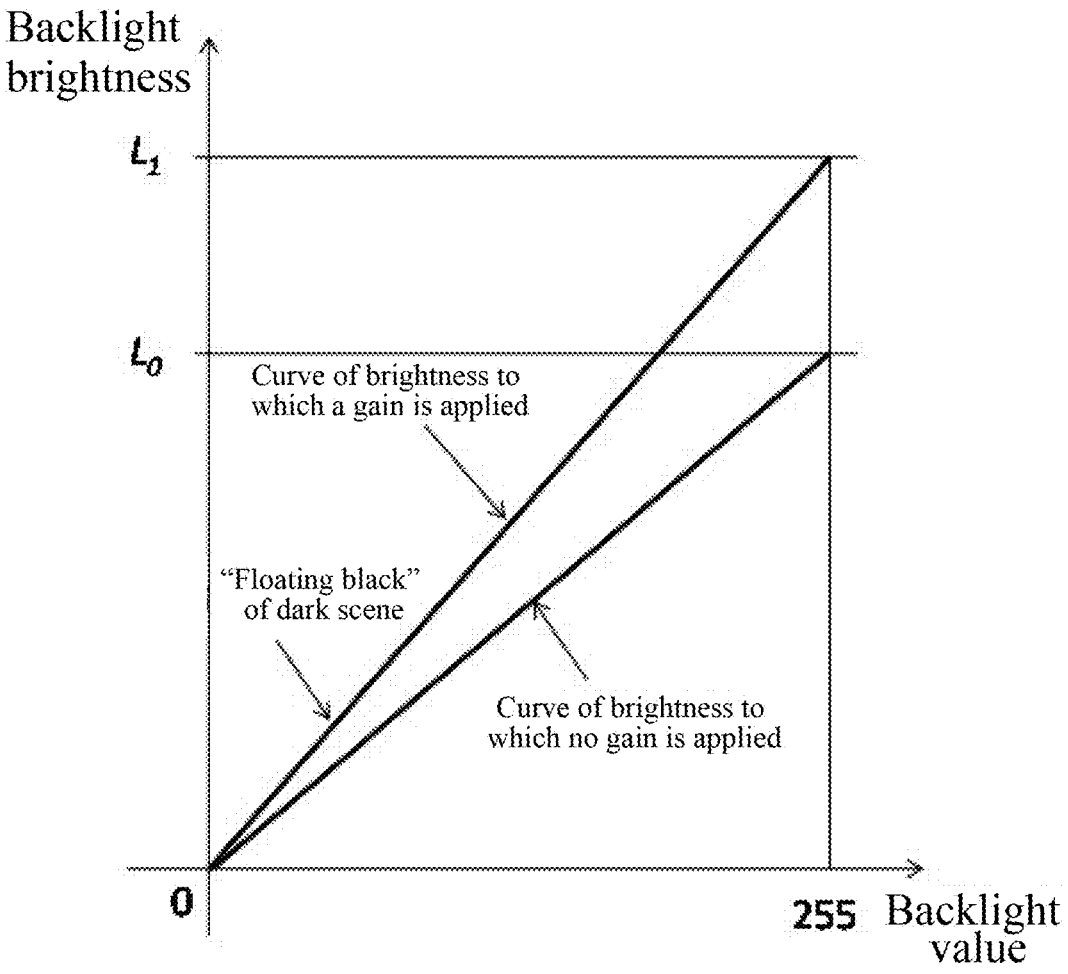
FIG. 8 is a schematic diagram of a comparison between a backlight value to which no gain is applied, and the backlight value to which a gain is applied, according to an embodiment of this disclosure.

In some embodiments above of the invention, on the one hand, the pre-obtained a zone backlight value are calculated from grayscale values of a zone image data block, and then a backlight gain coefficient is further obtained, and the pre-obtained zone backlight value is multiplied with the backlight gain coefficient to obtain a zone backlight value to which the gain is applied, which are output to a backlight driver circuit to drive a backlight source in a backlight zone corresponding to the zone image data block, thus improving the backlight peak brightness, and further enhancing the dynamic contrast of a displayed image. As illustrated in FIG. 8 which is a schematic diagram of comparison between backlight values before and after a gain is applied according to the first embodiment of the invention, the comparison between the unchanged and changed backlight brightness can show that the maximum peak brightness of backlight in the brightness curve to which no gain is applied is $L_0$, and the maximum peak brightness of backlight to which the gain is applied is $L_1$, so them is a significant improvement of the backlight brightness in the brightness curve to which the gain is applied, over the brightness curve to which no gain is applied.

On the other hand, there is a significant improvement of the backlight brightness after a gain is applied, over the backlight brightness before the gain is applied. Thus both the display grayscales and the backlight brightness of pictures at high brightness will be high while the pictures are being displayed. Thus the display brightness of the pictures of an image will be high. At this time, if there is high ambient brightness, then the improved backlight brightness will encourage the presentation of the pictures, whereas if there is low ambient brightness, and the backlight is also improved significantly so that the pictures are displayed at high brightness, then there will be such a sharp contrast between the pictures of the image at high brightness and the ambient brightness that the pictures may be glaring, thus discouraging the presentation of the displayed pictures of the image.

Thus, a second embodiment of this disclosure proposes another method for controlling liquid crystal display brightness. In this second embodiment, a factor of ambient luminance will be further taken into account for amplitude of backlight gain. If there is high ambient luminance, then the amplitude of the backlight gain will be large, and if there is low ambient luminance, then the amplitude of the backlight gain will be small.

Figure 10:
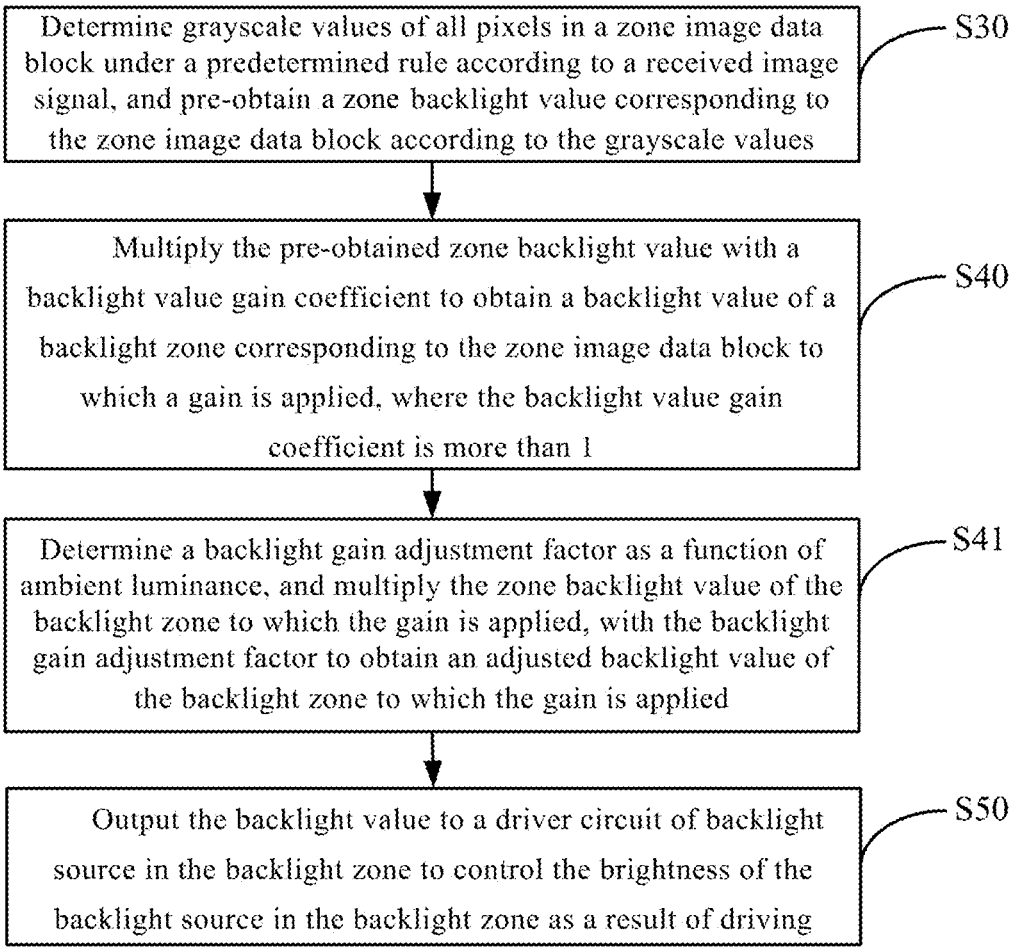
FIG. 10 is a schematic flowchart of another method for controlling liquid crystal display brightness according to an embodiment of this disclosure.

FIG. 10 is a schematic flowchart of another method for controlling liquid crystal display brightness according to the second embodiment of the invention. Between the steps S40 and S50 in the first embodiment, the method particularly includes:

The step S41 is to determine a backlight gain adjustment factor as a function of ambient luminance, and to multiply a zone backlight value of a backlight zone corresponding to a zone image data block to which the gain is applied, with the backlight gain adjustment factor to obtain an adjusted backlight value of the backlight zone to which the gain is applied.

Then particularly in the step S50, the adjusted backlight value of the backlight zone to which the gain is applied are output to a driver circuit of backlight source in the backlight zone to control the brightness of the backlight source in the backlight zone as a result of driving.

In this embodiment, a relationship table between the ambient luminance and a backlight gain adjustment factor $\alpha$ can be preset, the ambient luminance can be acquired, and then a lookup table can be searched for the backlight gain adjustment factor $\alpha$ corresponding to acquired ambient luminance. By way of an example, $BLN'=BLN*Gain*\alpha$, where BLN' represents an adjusted backlight value of the n-th backlight zone, BLn represents a pre-obtained zone backlight value of the n-th backlight zone, Gain represents a backlight gain coefficient of the n-th backlight zone, n represents any one of backlight zone sequence numbers 1 to N, and N represents the total number of backlight zones.

Figure 11:
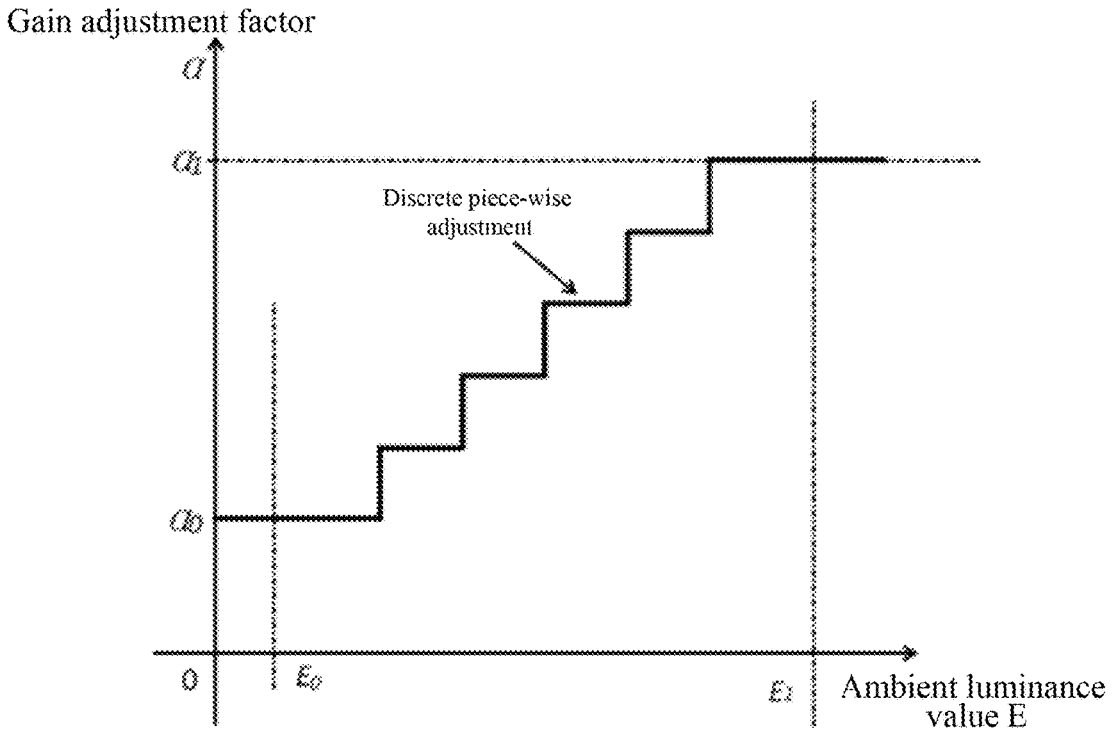
FIG. 11 is a schematic diagram of a discrete piece-wise adjustment relationship curve of an ambient luminance value vs. a gain adjustment factor according to an embodiment of this disclosure.
Figure 12:
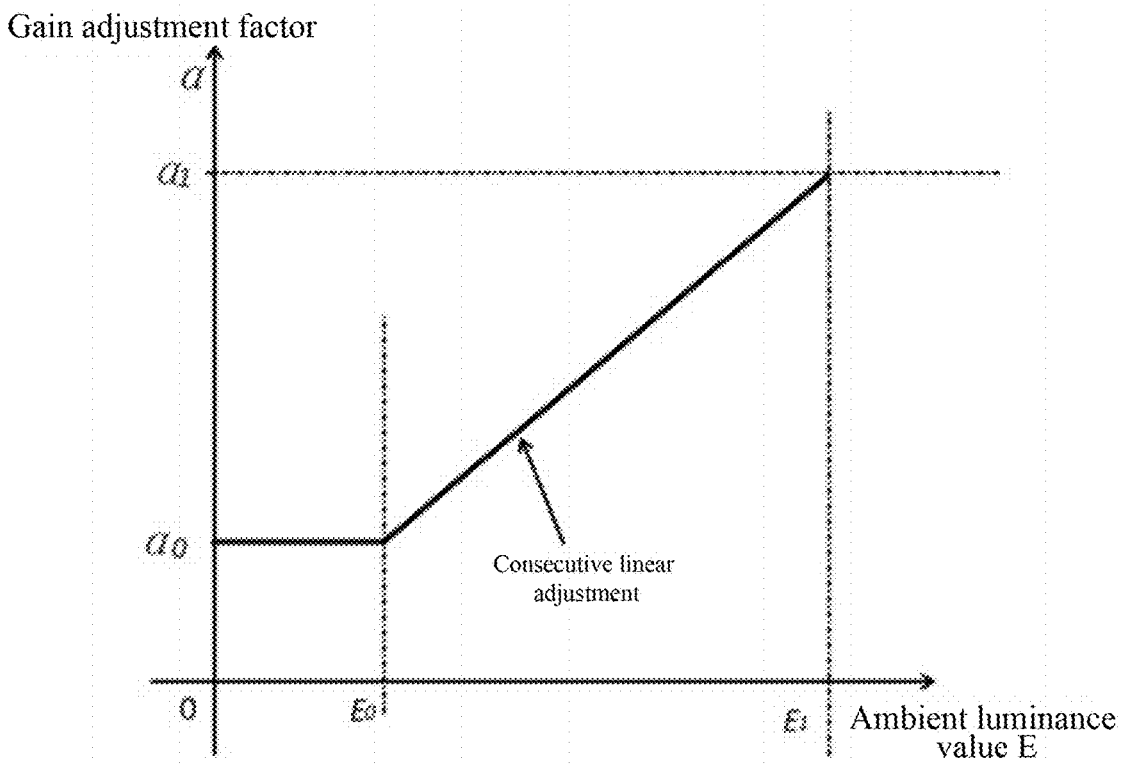
FIG. 12 is a schematic diagram of a consecutive linear adjustment relationship curve of an ambient luminance value vs. a gain adjustment factor according to an embodiment of this disclosure.

It shall be noted that the backlight gain adjustment factor $\alpha$ varies with the varying ambient luminance in the relationship table. There is a larger backlight gain adjustment factor $\alpha$ corresponding to a larger ambient luminance value, where $\alpha$ can be adjusted in two modes of discrete piece-wise adjustment and consecutive linear adjustment. FIG. 11 is a schematic diagram of a discrete piece-wise adjustment relationship curve of an ambient luminance value vs. a gain adjustment factor according to an embodiment of this disclosure. As illustrated in FIG. 11, in the discrete piece-wise mode, different ambient luminance values $E_0$ to $E_1$ are divided into several intervals, each of which corresponds to a value of $\alpha$. FIG. 12 is a schematic diagram of a consecutive linear adjustment relationship curve of an ambient luminance value vs. a backlight gain adjustment factor according to an embodiment of this disclosure. As illustrated in FIG. 12, in the consecutive linear mode, there is a linear function relationship between a and the ambient luminance value, which can be represented as $\alpha=\alpha_0+k*E$, where $\alpha_0$ represents a constant, and k represents a variation rate at which the backlight gain adjustment factor $\alpha$ varies with the ambient luminance value E.

In the second embodiment above, since the factor of the ambient luminance is taken into account for the amplitude of the zone backlight value gain, if there is high ambient luminance, then there will be a large amplitude of the backlight gain, and if there is low ambient luminance, then there will be a small amplitude of the backlight gain. The backlight gain adjustment factor $\alpha$ can be introduced to adjust the contrast between the backlight brightness and the ambient brightness.

Figure 13:
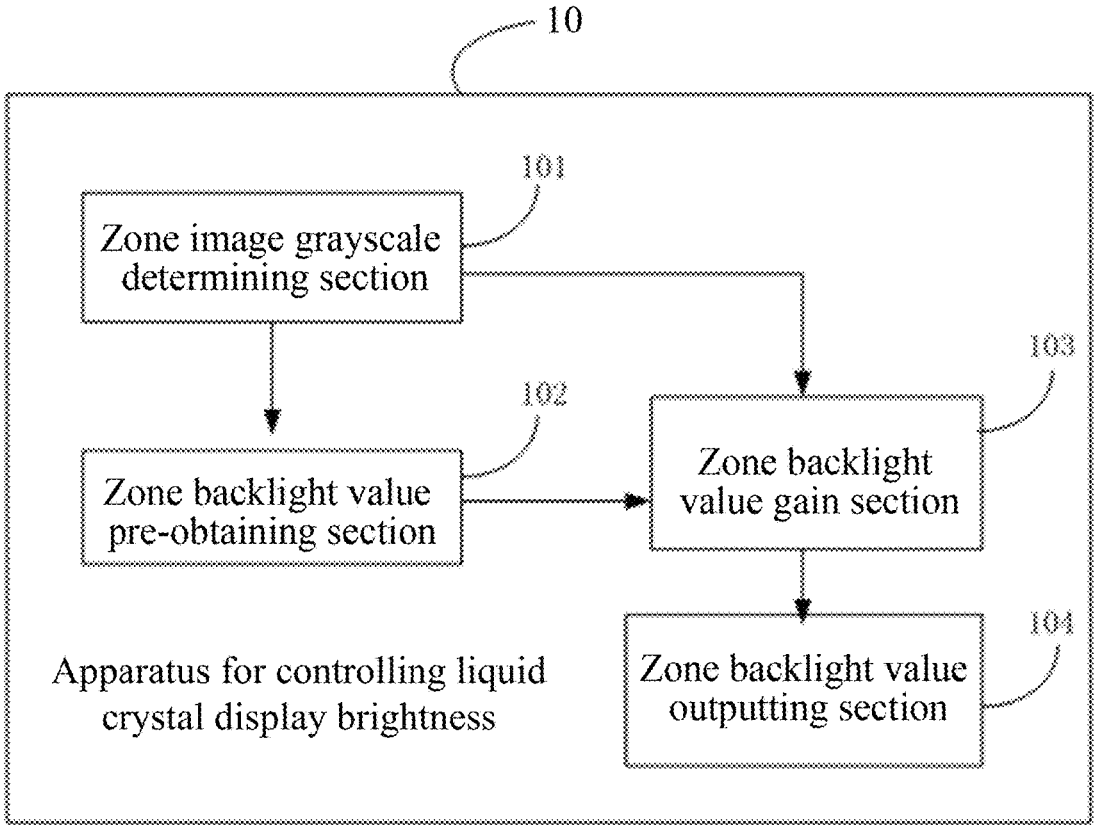
FIG. 13 is a schematic structural diagram of an apparatus for controlling liquid crystal display brightness according to an embodiment of this disclosure.

FIG. 13 is a schematic structural diagram of an apparatus for controlling liquid crystal display brightness according to a third embodiment of this disclosure. As illustrated in FIG. 13, the apparatus 10 for controlling liquid crystal display brightness can be a single video processing chip or a number of video processing chips, e.g., two video processing chips, and the apparatus 10 for controlling liquid crystal display brightness can include:

A zone image grayscale determining section 101 is configured to determine grayscale values of pixels in a zone image data block under a predetermined rule according to a received image signal;

A zone backlight value pre-obtaining section 102 is configured to pre-obtain a zone backlight value corresponding to the zone image data block according to the grayscale values in the zone image data block;

A zone backlight value gain section 103 is configured to multiply the pre-obtained zone backlight value with a backlight value gain coefficient to obtain a backlight value of a backlight zone corresponding to the zone image data block to which a gain is applied, where the backlight value gain coefficient is more than 1; and A zone backlight value outputting section 104 is configured to output the backlight value of the backlight zone to a driver circuit of backlight source in the backlight zones to control the brightness of the backlight source in the backlight zone as a result of driving.

For details about the functions and processing flows of the respective units in the apparatus 10 for controlling liquid crystal display brightness according to this embodiment, reference can be made to the detailed description of the method for controlling liquid crystal display brightness according to the first embodiment above, so a repeated description thereof will be omitted here.

Figure 14A:
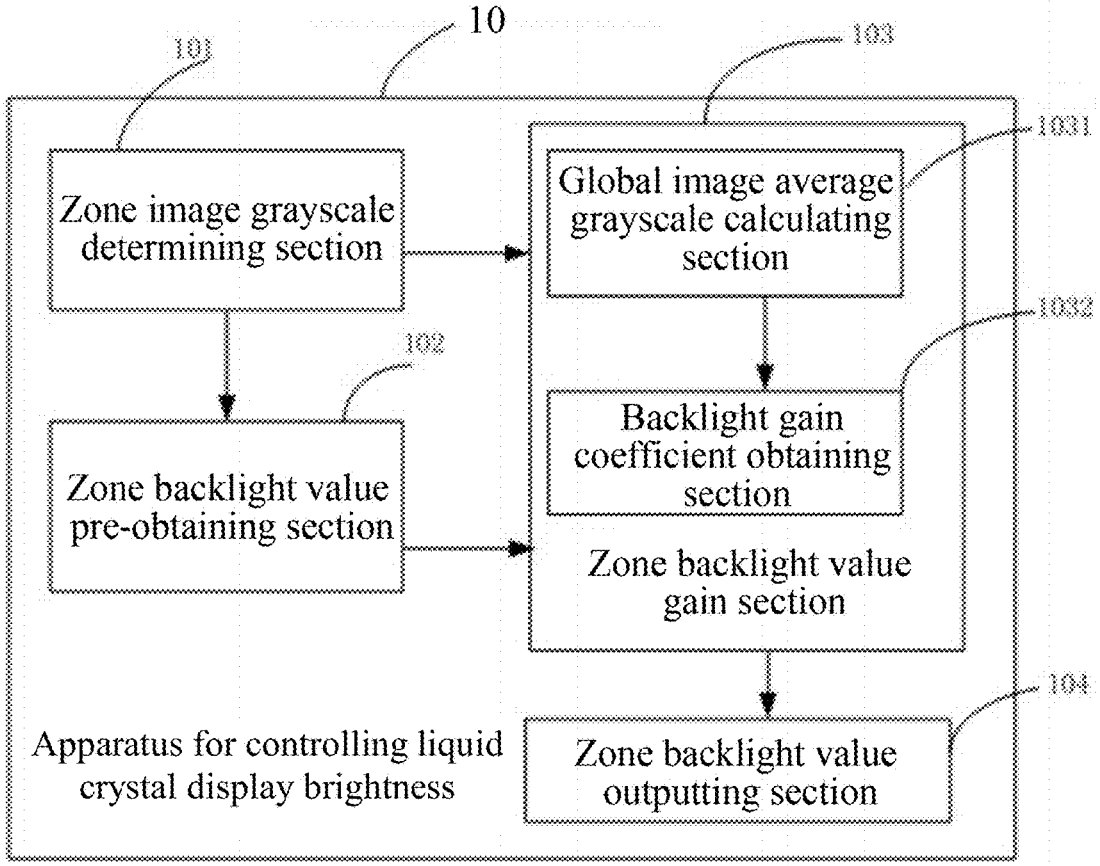
FIG. 14A is a schematic structural diagram of another apparatus for controlling liquid crystal display brightness according to an embodiment of this disclosure.

FIG. 14A is a schematic structural diagram of another apparatus for controlling liquid crystal display brightness according to this third embodiment, where the zone backlight value gain section 103 particularly includes:

A global image average grayscale calculating section 1031 is configured to obtain an average grayscale value of a global image according to grayscale values of the image; and A backlight gain coefficient obtaining section 1032 is configured to determine a backlight value gain coefficient according to a relationship between the average grayscale value of the global image and the backlight value gain coefficient.

Figure 14B:
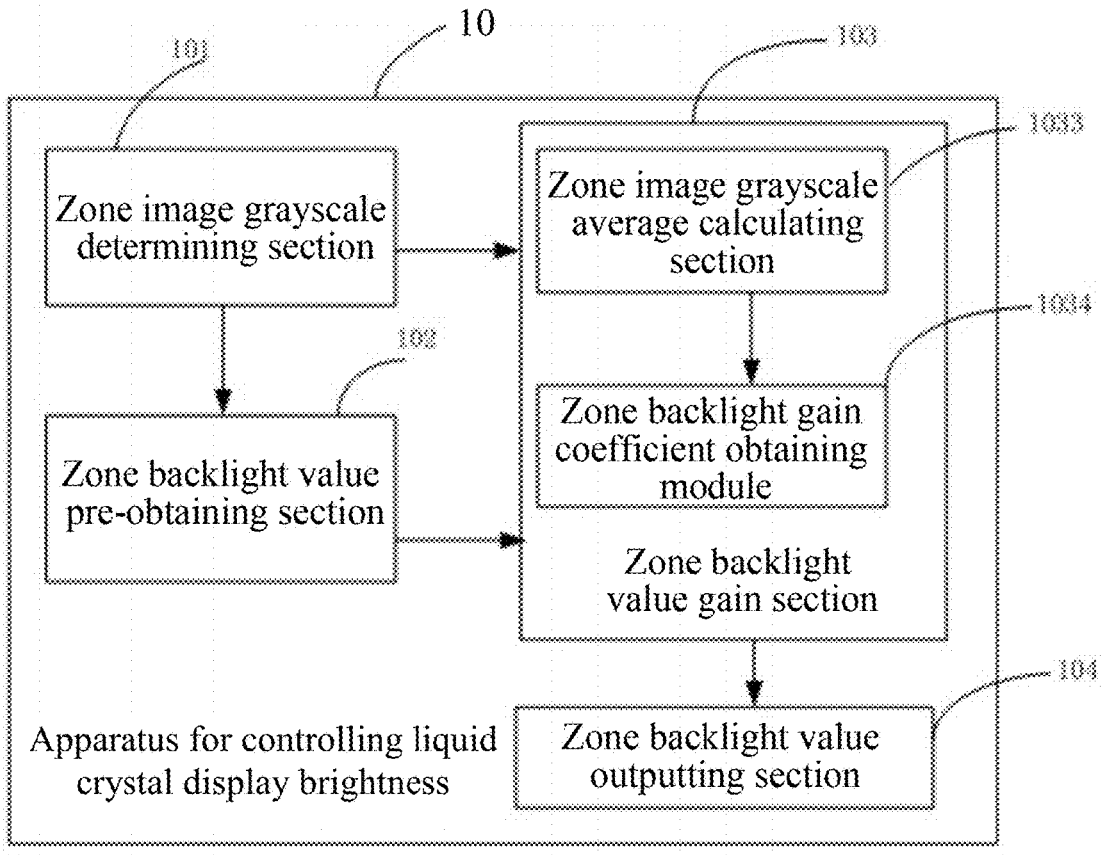
FIG. 14B is a schematic structural diagram of still another apparatus for controlling liquid crystal display brightness according to an embodiment of this disclosure.

FIG. 14B is a schematic structural diagram of another apparatus for controlling liquid crystal display brightness according to this third embodiment, where the zone backlight value gain section 103 further includes:

A zone image grayscale average calculating section 1033 is configured to obtain an average grayscale value of all pixels in a zone image data block cluster, where all zone image data blocks are determined as a number of the zone image data block clusters, each of which includes a number of adjacent zone image data blocks; and A zone backlight gain coefficient obtaining module 1034 is configured to determine a backlight value gain coefficient according to a relationship between the average grayscale value of all pixels in the zone image data block cluster and the backlight value gain coefficient.

The zone backlight value gain section 103 particularly includes:

A number of preset gain coefficient lookup tables, where there are at least two zone image data block clusters corresponding to different lookup tables in which different relationships between a backlight value gain coefficient and an average grayscale value are recorded.

The zone backlight value gain section 103 is further configured:

To match a gain coefficient relationship lookup table to a position where a zone image data block cluster is distributed on a display area.

The zone backlight value gain section 103 particularly includes:

A gain curve between an average grayscale value of an image and a backlight value gain coefficient is recorded in each of the backlight value gain coefficient lookup tables, where the gain curve is divided sequentially into a low brightness enhancement interval, a high brightness enhancement interval, and a power control interval while the average grayscale value is increasing, and the gain coefficients in the high brightness enhancement interval is more than those in the low brightness enhancement interval and the power control interval respectively.

This third embodiment of this disclosure provides another structure of an apparatus for controlling liquid crystal display brightness (not illustrated) as follows: the controlling liquid crystal display brightness includes: at least one processor, and a memory storing at least one instruction executable by the at least one processor, where the at least one instruction is configured to be executed by the at least one processor so that the apparatus for controlling liquid crystal display brightness determines grayscale values of pixels in a zone image data block under a predetermined rule according to a received image signal; pre-obtains a zone backlight value corresponding to the zone image data block according to the grayscale values of the pixels in the zone image data block; multiplies the pre-obtained zone backlight value with a backlight value gain coefficient to obtain a backlight value of a backlight zone corresponding to the zone image data block to which a gain is applied, where the backlight value gain coefficient is more than 1; and outputs the backlight value of the backlight zone to a driver circuit of backlight source in the backlight zone to control the brightness of the backlight source in the backlight zone as a result of driving.

The at least one instruction is further configured to be executed by the at least one processor so that the apparatus for controlling liquid crystal display brightness obtains an average grayscale value of a global image according to the grayscale values; and determines the backlight value gain coefficient according to a relationship between the average grayscale value of the global image and the backlight value gain coefficient.

The at least one instruction is further configured to be executed by the at least one processor so that the apparatus for controlling liquid crystal display brightness obtains an average grayscale value of all pixels in a zone image data block cluster, where all zone image data blocks are determined as a number of the zone image data block clusters, each of which includes a number of adjacent zone image data blocks; and determines the backlight value gain coefficient according to a relationship between the zone image data block cluster and the backlight value gain coefficient.

A number of gain coefficient lookup tables are preset in the memory, where there are at least two zone image data block clusters corresponding to different lookup tables in which different relationships between a backlight value gain coefficient and an average grayscale value are recorded. A gain curve between an average grayscale value of an image and a backlight value gain coefficient is recorded in each of the backlight value gain coefficient lookup tables, where the gain curve is divided sequentially into a low brightness enhancement interval, a high brightness enhancement interval, and a power control interval while the average grayscale value is increasing, and the gain coefficients in the high brightness enhancement interval are more than those in the low brightness enhancement interval and the power control interval respectively.

The at least one instruction is further configured to be executed by the at least one processor so that the apparatus for controlling liquid crystal display brightness matches a gain coefficient relationship lookup table to a position where a zone image data block cluster is distributed on a display area.

For details about the functions and processing flows of the respective units in the apparatus 10 for controlling liquid crystal display brightness according to this embodiment, reference can be made to the detailed description of the method for controlling liquid crystal display brightness according to the first embodiment above, so a repeated description thereof will be omitted here.

Figure 15:
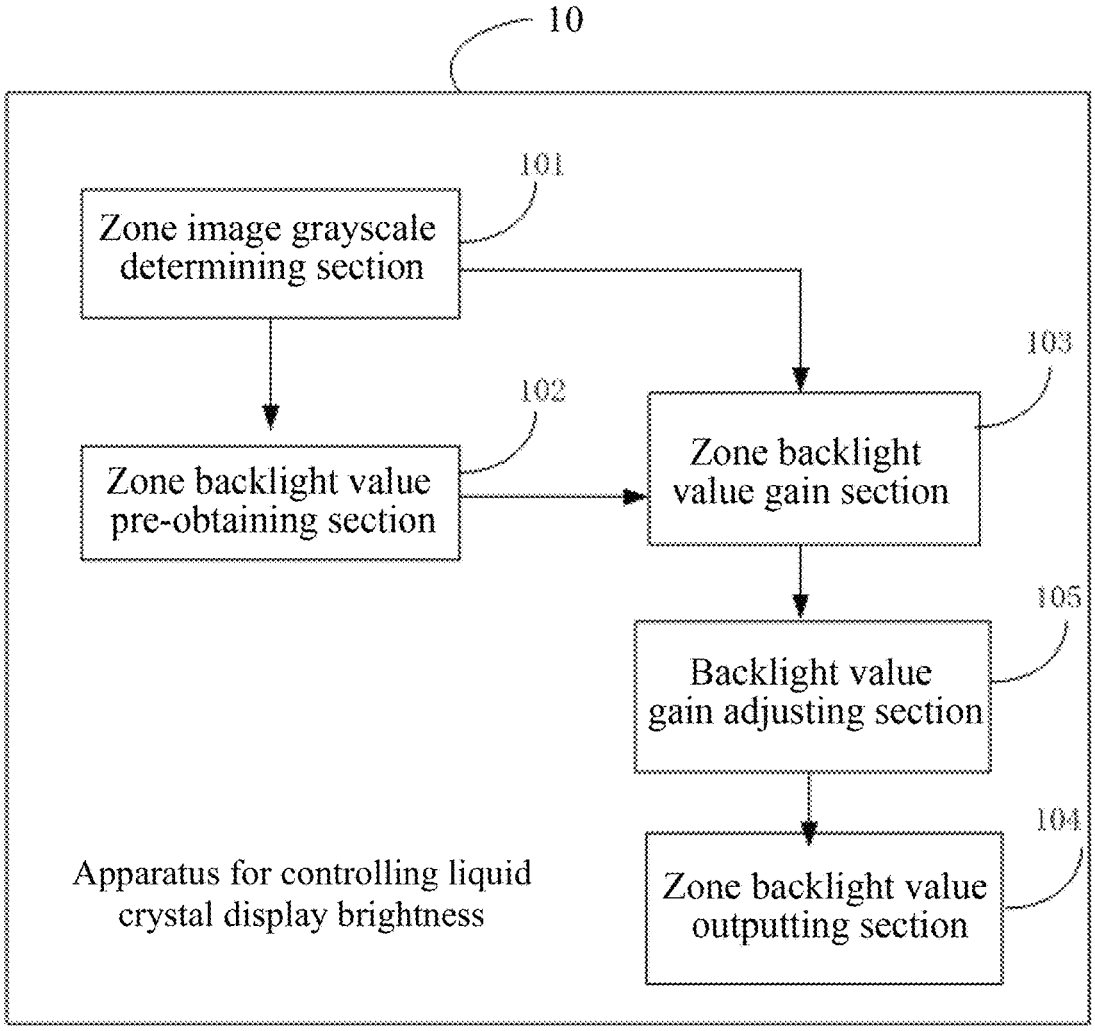
FIG. 15 is a schematic structural diagram of a further apparatus for controlling liquid crystal display brightness according to an embodiment of this disclosure.

FIG. 15 is a schematic structural diagram of an apparatus for controlling liquid crystal display brightness according to a fourth embodiment of this disclosure. As illustrated in FIG. 15, the apparatus 10 for controlling liquid crystal display brightness can be a single video processing chip or a number of video processing chips, e.g., two video processing chips, and unlike the third embodiment, between the zone gain value gain section 103 and the zone backlight value outputting section 104, the apparatus 10 for controlling liquid crystal display brightness further includes:

A backlight value revising section 105 is configured, when an average grayscale value of an image is below a first threshold, to multiply the zone backlight value to which the gain is applied, with a revision coefficient to obtain an adjusted zone backlight value to which the gain is applied, where the revision coefficient is determined as a function of dispersity of image brightness distribution, and the revision coefficient is less than 1.

The zone backlight value outputting section 104 is further configured to output the adjusted zone backlight value of a backlight zone corresponding to the zone image data block to which the gain is applied, to a driver circuit of backlight source in the backlight zone to control the brightness of the backlight source in the backlight zones as a result of driving.

For details about the functions and processing flows of the respective units in the apparatus 10 for controlling liquid crystal display brightness according to this embodiment, reference can be made to the detailed description of the method for controlling liquid crystal display brightness according to the second embodiment above, so a repeated description thereof will be omitted here.

Figure 16:
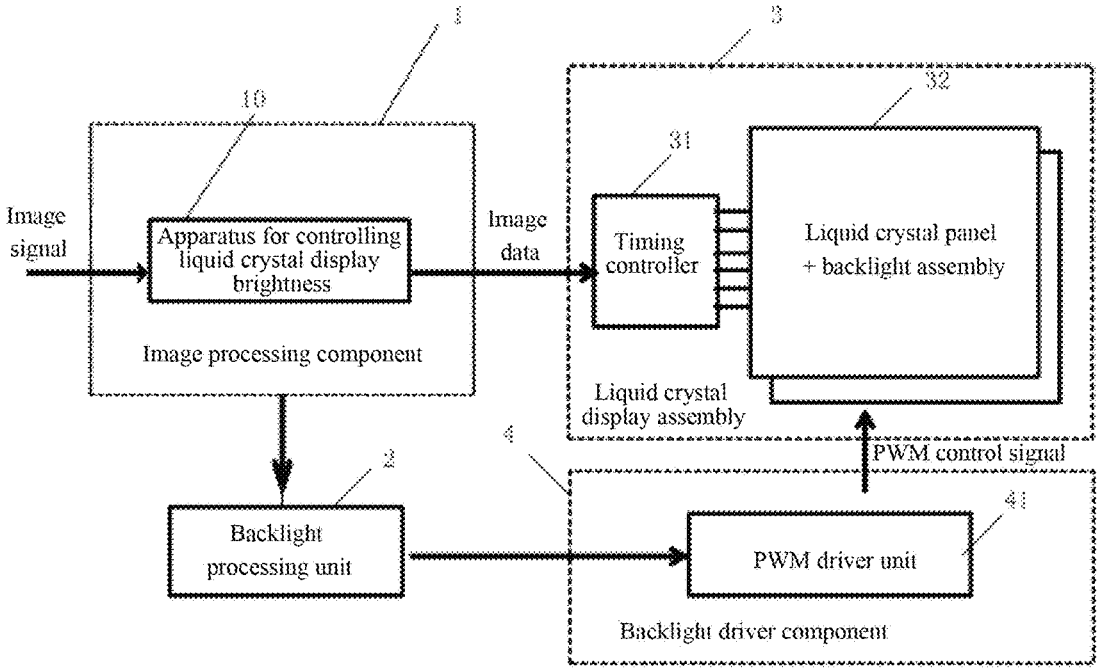
FIG. 16 is a schematic structural diagram of a liquid crystal display device according to an embodiment of this disclosure.

FIG. 16 is a schematic structural diagram of a liquid crystal display device according to a fifth embodiment of this disclosure. The liquid crystal display device includes an image processing component 1, a memory (not illustrated), a liquid crystal display assembly 3, a backlight processing unit 2, and a backlight driver component 4, where:

The memory is configured to store programs and various preset lookup table data;

The image processing component 1 includes the apparatus 10 for controlling liquid crystal display brightness;

The apparatus 10 for controlling liquid crystal display brightness of the image processing component 1 is further configured to receive an image signal, to process the data, and to output the image data to a timing controller (Tcon) 31 in the liquid crystal display assembly 3 so that the Tcon 31 generates a driver signal according to image data to control a liquid crystal panel of the liquid crystal panel and backlight assembly 32 to display the image; and further configured to output zone backlight values according to the image signal;

The backlight processing unit 2 is configured to determine duty ratios of corresponding PWM signals according to the backlight values of backlight zones, and to output the duty ratios; and The PWM driver unit 41 of the backlight driver component 4 is configured to generate PWM control signals to control backlight sources of backlight zones in the backlight component of the liquid crystal panel and backlight assembly 32.

Here, the apparatus 10 for controlling liquid crystal display brightness is any one of the apparatuses 10 for controlling liquid crystal display brightness according to any one of the third and fourth embodiments. A repeated description of the particular functions of the apparatus 10 for controlling liquid crystal display brightness will be omitted here.

Figure 17:
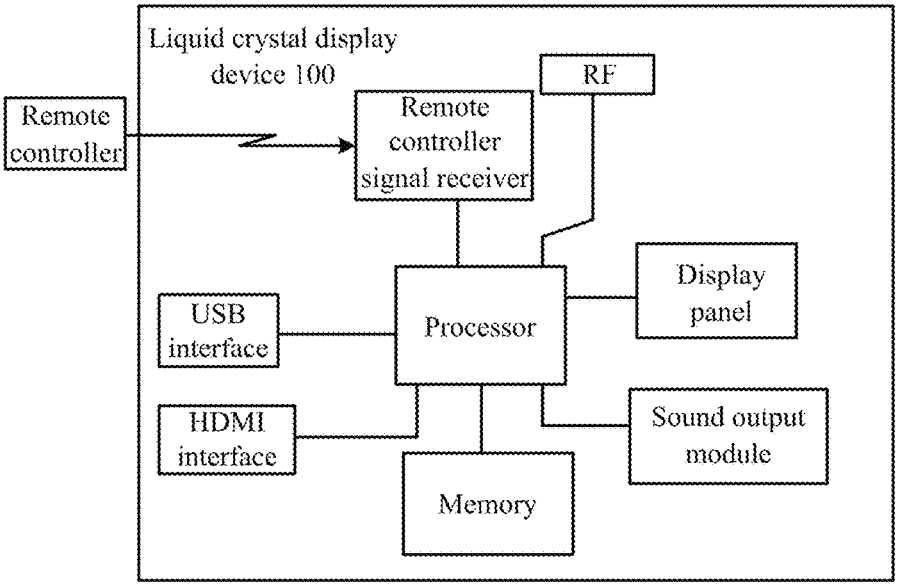
FIG. 17 is a schematic structural diagram of a liquid crystal display device according to some embodiments of this disclosure.

FIG. 17 illustrates a schematic structural diagram of a liquid crystal display device 100 according to some embodiments of this disclosure, where the liquid crystal display device 100 can include a memory, an input unit, an output unit, one or more processors, and other components. Those skilled in the art can appreciate that the liquid crystal display device 100 will not be limited to the structure of the liquid crystal display device illustrated in FIG. 17, but can include more or less components than those as illustrated or some of the components can be combined or different components can be arranged, where:

The memory can be configured to store software programs and modules, and the processor can be configured to run the software programs and modules stored in the memory to thereby perform various function applications and data processing. The memory can include a high-speed random access memory and can further include a nonvolatile memory, e.g., at least one magnetic disk memory device, a flash memory device or another volatile solid memory device. Moreover, the memory can further include a memory controller configured to provide an access of the processor and the input unit to the memory.

The processor is a control center of the liquid crystal display device 100, has the respective components of the entire liquid crystal display device connected by various interfaces and lines, and runs or executes the software programs and/or the modules stored in the memory and invokes the data stored in the memory to perform the various functions of the liquid crystal display device 100 and process the data to thereby manage and control the liquid crystal display device as a whole. Optionally, the processor can include one or more processing cores; and preferably the processor can be integrated with an application processor and a modem processor, where the application processor generally handles the operating system, the user interfaces, the applications, etc., and the modem processor generally handles wireless communication. As can be appreciated, the modem processor may not be integrated into the processor.

The liquid crystal display device 100 can include a TV and radio receiver, a High-Definition Multimedia interface (HDMI), a USB interface, an audio and video input interface, and other input units, and the input units can further include a remote control receiver to receive a signal sent by a remote controller. Moreover, the input units can further include a touch sensitive surface and other input devices, where the touch sensitive surface can be embodied in various types of resistive, capacitive, infrared, surface sound wave, and other types, and the other input device can include but will not be limited to one or more of a physical keyboard, functional keys (e.g., a power-on or -off press key, etc.), a track ball, a mouse, a joystick, etc.

The output unit is configured to output an audio signal, a video signal, an alert signal, a vibration signal, etc. The output unit can include a display panel, a sound output module, etc. The display panel can be configured to display information input by a user or information provided to the user and various graphic user interfaces of the liquid crystal display device 100, where these graphic user interfaces can be composed of graphics, texts, icons, videos, and any combination thereof. For example, the display panel can be embodied as a Liquid Crystal Display (LCD), an Organic Light-Emitting Diode (OLED), a flexible display, a 3D display, a CRT, a plasma display panel, etc.

The liquid crystal display device 100 can further include at least one sensor (not illustrated), e.g., an optical sensor, a motion sensor and other sensors. Particularly, the optical sensor can include an ambient optical sensor and a proximity sensor, where the ambient optical sensor can adjust the brightness of the display panel according to the luminosity of ambient light rays, and the proximity sensor can power off the display panel and/or a backlight when the liquid crystal display device 100 moves to some position. The liquid crystal display device 100 can be further configured with a gyroscope, a barometer, a hygrometer, a thermometer, an infrared sensor, and other sensors.

The liquid crystal display device 100 can further include an audio circuit (not illustrated), and a speaker and a transducer can provide an audio interface between the user and the liquid crystal display device 100. The audio circuit can convert received audio data into an electric signal and transmit the electric signal to the speaker, which is converted by the speaker into an audio signal for output, and on the other hand, the transducer converts a collected audio signal into an electric signal which is received by the audio circuit and then converted into audio data, and the audio data is further output to the processor for processing and then transmitted to another terminal, for example, or the audio data is output to the memory or further processing. The audio circuit may further include an earphone jack for communication between a peripheral earphone and the liquid crystal display device 100.

Moreover, the liquid crystal display device 100 can further include a Radio Frequency (RF) circuit. The RF circuit can be configured to receive and transmit a signal. Typically, the RF circuit includes but will not be limited to an antenna, at least one amplifier, a tuner, one or more oscillators, a Subscriber Identifier Module (SIM) card, a transceiver, a coupler, a Low Noise Amplifier (LNA), a duplexer, etc. Moreover, the liquid crystal display device 100 can further include a web cam, a Bluetooth module, etc.

Moreover the liquid crystal display device 100 further includes a Wireless Fidelity (WiFi) module (not illustrated). The WiFi is a technology of short-range wireless transmission, and the liquid crystal display device 100 can assist the user in transmitting and receiving an email, browsing a web page, accessing streaming media, etc., and also provide the user with a wireless broadband access to the Internet, through the WiFi module. It can be appreciated that the WiFi module may not necessarily be included in the liquid crystal display device 100, but can be omitted as required without departing from the scope of this disclosure.

Those ordinarily skilled in the art can appreciate that all or a part of the steps in the methods according to the embodiments described above can be performed by program instructing relevant hardware, where the programs can be stored in a computer readable storage medium, and the programs can perform one or a combination of the steps in the method embodiments upon being executed; and the storage medium includes an ROM, an RAM, a magnetic disc, an optical disk, or any other medium which can store program codes.

Lastly, it shall be noted that the foregoing embodiments are merely intended to illustrate but not to limit the technical solutions of this disclosure, and although this disclosure has been described in details with reference to the foregoing embodiments, those ordinarily skilled in the art shall appreciate that the technical solutions recited in the foregoing respective embodiments can be modified or equivalent substitutions can be made to a part of the technical features thereof, and the essence of the corresponding technical solutions will not depart from the spirit and scope of the technical solutions according to the respective embodiments of this disclosure due to these modifications or substitutions.

The invention claimed is:

1. A method of controlling liquid crystal display brightness, the method comprising:

determining, by a liquid crystal display device, grayscale values of pixels in a zone image data block under a predetermined rule according to a received image signal, and pre-obtaining a zone backlight value corresponding to the zone image data block according to the grayscale values of the pixels in the zone image data block;

multiplying, by the liquid crystal display device, the pre-obtained zone backlight value with a backlight value gain coefficient to obtain a backlight value of a backlight zone corresponding to the zone image data block to which a gain is applied, wherein the backlight value gain coefficient is more than 1;

determining, by the liquid crystal display device, a backlight gain adjustment factor as a function of ambient luminance, and multiplying the zone backlight value of the backlight zone to which the gain is applied, with the backlight gain adjustment factor to obtain an adjusted backlight value of the backlight zone to which the gain is applied; and outputting, by the liquid crystal display device, the adjusted backlight value of the backlight zone to which the gain is applied to a driver circuit of a backlight source in the backlight zone to control the brightness of the backlight source in the backlight zone as a result of the driver circuit driving the backlight source.

2. The method according to claim 1, wherein a relationship between the backlight gain adjustment factor and the ambient luminance is set so that the backlight gain adjustment factor becomes larger with a larger ambient luminance value.

3. The method according to claim 1, wherein the backlight gain adjustment factor is determined by dividing, by the liquid crystal display device, different ambient luminance values into several intervals, each of the intervals corresponding to a value of the backlight gain adjustment factor.

4. The method according to claim 1, wherein the backlight gain adjustment factor is determined by presetting, by the liquid crystal display device, a linear function relationship between a backlight gain adjustment factor $\alpha$ and an ambient luminance value E as $\alpha=\alpha_0+k*E$, wherein $\alpha_0$ represents a constant, and k represents a variation rate at which the backlight gain adjustment factor $\alpha$ varies with the ambient luminance value E.

5. The method according to claim 1, wherein the backlight value gain coefficient is obtained by:

obtaining, by the liquid crystal display device, an average grayscale value of all pixels in a zone image data block cluster, wherein all zone image data blocks are determined as a number of the zone image data block clusters, each of the zone image data block clusters comprises a number of adjacent zone image data blocks; and determining, by the liquid crystal display device, the backlight value gain coefficient according to a relationship between the average grayscale value and the backlight value gain coefficient.

6. The method according to claim 5, wherein the relationship between the average grayscale value and the backlight value gain coefficient is determined by:

presetting, by the liquid crystal display device, a number of backlight value gain coefficient lookup tables so that at least two zone image data block clusters correspond to different backlight value gain coefficient lookup tables in which different relationships between the backlight value gain coefficient and the average grayscale value of all the pixels in the zone image data block cluster are recorded; and matching, by the liquid crystal display device, a gain coefficient relationship lookup table to a position where the zone image data block cluster is distributed on a display area;

wherein a gain curve between the average grayscale value of all the pixels in the zone image data block cluster and the backlight value gain coefficient is recorded in each of the backlight value gain coefficient lookup tables, and the gain curve is divided sequentially into a low brightness enhancement interval, a high brightness enhancement interval, and a power control interval while the average grayscale value is increasing, wherein backlight value gain coefficients in the high brightness enhancement interval are more than those in the low brightness enhancement interval and the power control interval respectively.

7. An apparatus to control liquid crystal display brightness, the apparatus comprising:

a zone image grayscale determining section configured to determine grayscale values of pixels in a zone image data block under a predetermined rule according to a received image signal; a zone backlight value pre-obtaining section configured to pre-obtain a zone backlight value corresponding to the zone image data block according to the grayscale values of pixels in the zone image data block;

a zone backlight value gain section configured to multiply the pre-obtained zone backlight value with a backlight value gain coefficient to obtain a backlight value of a backlight zone corresponding to the zone image data block to which a gain is applied, wherein the backlight value gain coefficient is more than 1;

a backlight value gain adjusting section configured to determine a backlight gain adjustment factor as a function of ambient luminance, and to multiply the zone backlight value of the backlight zone to which the gain is applied, with the backlight gain adjustment factor to obtain an adjusted backlight value of the backlight zone to which the gain is applied; and a zone backlight value outputting section configured to output the adjusted backlight value of the backlight zone to which the gain is applied to a driver circuit of a backlight source in the backlight zone to control the brightness of the backlight source in the backlight zone as a result of the driver circuit driving the backlight source.

8. The apparatus according to claim 7, wherein the backlight value gain adjusting section is configured to determine the backlight gain adjustment factor so that the backlight gain adjustment factor becomes larger with a larger ambient luminance value.

9. The apparatus according to claim 7, wherein the backlight value gain adjusting section configured to determine the backlight gain adjustment factor is configured to divide different ambient luminance values into several intervals, each of the intervals corresponds to a value of the backlight gain adjustment factor.

10. The apparatus according to claim 7, wherein the backlight value gain adjusting section configured to determine the backlight gain adjustment factor is configured to determine a linear function relationship between a backlight gain adjustment factor $\alpha$ and an ambient luminance value E as $\alpha=\alpha_0+k*E$, wherein $\alpha_0$ represents a constant, and k represents a variation rate at which the backlight gain adjustment factor $\alpha$ varies with the ambient luminance value E.

11. The apparatus according to claim 7, wherein the zone backlight value gain section comprises:

a zone image grayscale average calculating section configured to obtain an average grayscale value of all pixels in a zone image data block cluster, wherein all zone image data blocks are determined as a number of the zone image data block clusters, each of the zone image data block clusters comprises a number of adjacent zone image data blocks; and a zone backlight gain coefficient obtaining module configured to determine the backlight value gain coefficient according to a relationship between the average grayscale value and the backlight value gain coefficient.

12. The apparatus according to claim 11, wherein the zone backlight gain coefficient obtaining module is configured to determine the relationship between the average grayscale value and the backlight value gain coefficient is configured to:

preset a number of backlight value gain coefficient lookup tables so that at least two zone image data block clusters correspond to different backlight value gain coefficient lookup tables in which different relationships between the backlight value gain coefficient and the average grayscale value of all the pixels in the zone image data block cluster are recorded; and match a gain coefficient relationship lookup table to a position where the zone image data block cluster is distributed on a display area;

wherein a gain curve between the average grayscale value of all the pixels in the zone image data block cluster and the backlight value gain coefficient is recorded in each of the backlight value gain coefficient lookup tables, and the gain curve is divided sequentially into a low brightness enhancement interval, a high brightness enhancement interval, and a power control interval while the average grayscale value is increasing, wherein backlight value gain coefficients in the high brightness enhancement interval are more than those in the low brightness enhancement interval and the power control interval respectively.

13. The apparatus according to claim 7, wherein the apparatus further comprises:

a backlight value revising section configured, when the average grayscale value of all the pixels in the zone image data block cluster is below a first threshold, to multiply the zone backlight value to which the gain is applied, with a revision coefficient to obtain an adjusted zone backlight value to which the gain is applied, wherein the revision coefficient is determined as a function of dispersity of image brightness distribution, and the revision coefficient is less than 1; and the zone backlight value outputting section is further configured to output the adjusted zone backlight value of the backlight zone to which the gain is applied, to the driver circuit of the backlight source in the backlight zone to control the brightness of the backlight source in the backlight zone as a result of the driver circuit driving the backlight source.

14. A liquid crystal display device, comprising:

a memory configured to store programs and various preset lookup table data;

an apparatus to control liquid crystal display brightness configured to receive an image signal, to process data, and to output image data to a timing controller so that the timing controller generates a driver signal according to the image data to control a liquid crystal panel to display an image; and further configured to output zone backlight values to a backlight processing unit according to the image signal;

the backlight processing unit configured to determine duty ratios of corresponding PWM signals according to the backlight values of backlight zones, and to output the duty ratios to a PWM driver unit; and the PWM driver unit configured to generate PWM control signals to control backlight sources in the backlight zones;

wherein the apparatus to control liquid crystal display brightness comprises:

a zone image grayscale determining section configured to determine grayscale values of all pixels in a zone image data block under a predetermined rule according to the received image signal;

a zone backlight value pre-obtaining section configured to pre-obtain a zone backlight value corresponding to the zone image data block according to the grayscale values of the pixels in the zone image data block;

a zone backlight value gain section configured to multiply the pre-obtained zone backlight value with a backlight value gain coefficient to obtain a backlight value of a backlight zone corresponding to the zone image data block to which a gain is applied, wherein the backlight value gain coefficient is more than 1;

a backlight value gain adjusting section configured to determine a backlight gain adjustment factor as a function of ambient luminance, and to multiply the zone backlight value of the backlight zone to which the gain is applied, with the backlight gain adjustment factor to obtain an adjusted backlight value of the backlight zone to which the gain is applied; and a zone backlight value outputting section configured to output the adjusted backlight value of the backlight zone to which the gain is applied to a driver circuit of backlight source in the backlight zone to control the brightness of the backlight source in the backlight zone as a result of the driver circuit driving the backlight source.

15. The liquid crystal display device according to claim 14, wherein the backlight value gain adjusting section is configured to determine the backlight gain adjustment factor so that the backlight gain adjustment factor becomes larger with a larger ambient luminance value.

16. The liquid crystal display device according to claim 14, wherein the backlight value gain adjusting section configured to determine the backlight gain adjustment factor is configured to divide different ambient luminance values into several intervals, each of the intervals corresponds to a value of the backlight gain adjustment factor.

17. The liquid crystal display device according to claim 14, wherein the backlight value gain adjusting section configured to determine the backlight gain adjustment factor is configured to determine a linear function relationship between a backlight gain adjustment factor $\alpha$ and an ambient luminance value E as $\alpha=\alpha_0+k*E$, wherein $\alpha_0$ represents a constant, and k represents a variation rate at which the backlight gain adjustment factor $\alpha$ varies with the ambient luminance value E.

18. The liquid crystal display device according to claim 14, wherein the zone backlight value gain section comprises:

a zone image grayscale average calculating section configured to obtain an average grayscale value of all pixels in a zone image data block cluster, wherein all zone image data blocks are determined as a number of the zone image data block clusters, each of which comprises a number of adjacent zone image data blocks; and a zone backlight gain coefficient obtaining module configured to determine the backlight value gain coefficient according to a relationship between the average grayscale value and the backlight value gain coefficient.

19. The liquid crystal display device according to claim 18, wherein the zone backlight gain coefficient obtaining module configured to determine the average grayscale value and the backlight value gain coefficient is configured to:

preset a number of backlight value gain coefficient lookup tables so that at least two zone image data block clusters correspond to different backlight value gain coefficient lookup tables in which different relationships between the backlight value gain coefficient and the average grayscale value of all the pixels in the zone image data block clusters are recorded; and match a gain coefficient relationship lookup table to a position where a zone image data block cluster is distributed on a display area;

wherein a gain curve between the average grayscale value of all the pixels in the zone image data block cluster and the backlight value gain coefficient is recorded in each of the backlight value gain coefficient lookup tables, and the gain curve is divided sequentially into a low brightness enhancement interval, a high brightness enhancement interval, and a power control interval while the average grayscale value is increasing, wherein gain coefficients in the high brightness enhancement interval are more than those in the low brightness enhancement interval and the power control interval respectively.

20. The liquid crystal display device according to claim 14, wherein the apparatus to control liquid crystal display brightness further comprises:

a backlight value revising section configured, when the average grayscale value of all the pixels in the zone image data block cluster is below a first threshold, to multiply the zone backlight value to which the gain is applied, with a revision coefficient to obtain an adjusted zone backlight value to which the gain is applied, wherein the revision coefficient is determined as a function of dispersity of image brightness distribution, and the revision coefficient is less than 1; and the zone backlight value outputting section is further configured to output the adjusted zone backlight value of the backlight zone to which the gain is applied, to the driver circuit of the backlight source in the backlight zone to control the brightness of the backlight source in the backlight zone as a result of the driver circuit driving the backlight source.

* * * * *